US009855471B2

(12) United States Patent
Mohr et al.

(10) Patent No.: US 9,855,471 B2
(45) Date of Patent: Jan. 2, 2018

(54) GROMMET STRIP

(71) Applicant: Head Technology GmbH, Kennelbach (AT)

(72) Inventors: Stefan Mohr, Dornbirn (AT); Christos Tsangalis, Bregenz (AT); Daniel Lau, Dornbirn (AT); Harald Rosenkranz, Lauterach (AT); Ralf Schwenger, Weiler (DE)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 14/535,188

(22) Filed: Nov. 6, 2014

(65) Prior Publication Data

US 2015/0157902 A1 Jun. 11, 2015

(30) Foreign Application Priority Data

Nov. 8, 2013 (DE) ..... 10 2013 018 837

(51) Int. Cl.
*A63B 49/00* (2015.01)
*A63B 49/022* (2015.01)
*A63B 49/02* (2015.01)

(52) U.S. Cl.
CPC ..... *A63B 49/002* (2013.01); *A63B 49/022* (2015.10); *A63B 2049/0201* (2015.10)

(58) Field of Classification Search
CPC ..... A63B 49/022; A63B 51/10
USPC ..... 473/539–542
See application file for complete search history.

(56) References Cited

U.S. PATENT DOCUMENTS

| | | | | |
|---|---|---|---|---|
| 5,993,337 | A * | 11/1999 | Janes | A63B 49/002 473/539 |
| 6,811,502 | B1 | 11/2004 | Janes et al. | |
| 7,691,016 | B2 | 4/2010 | Ashino | |
| 2006/0211526 | A1* | 9/2006 | Hauptman | A63B 51/00 473/524 |
| 2009/0017948 | A1* | 1/2009 | Ashino | A63B 49/022 473/522 |

FOREIGN PATENT DOCUMENTS

| | | | | |
|---|---|---|---|---|
| BE | 1003034 | | 10/1991 | |
| BE | 1003034 | A * | 10/1991 | A63B 49/00 |
| DE | 10 2006 032 075 | | 12/2007 | |
| GB | 2 196 537 | | 5/1988 | |

* cited by examiner

*Primary Examiner* — Aarti B Berdichevsky
*Assistant Examiner* — Rayshun Peng
(74) *Attorney, Agent, or Firm* — Bookoff McAndrews, PLLC

(57) ABSTRACT

The present invention relates to a grommet strip for a racket for ball games, wherein the grommet strip comprises a longitudinal direction and a plurality of grommets 1 comprising grommet through-holes 2, wherein each of the grommets 1 defines a grommet axis A and each of the grommet through-holes 2 defines a hole axis B, wherein the grommet axes A and the hole axes B extend substantially parallel to each other and wherein the hole axes B of some grommets are offset with respect to the grommet axes A thereof in the longitudinal direction of the grommet strip.

25 Claims, 22 Drawing Sheets

GROMMET STRIP

This application claims priority under 35 U.S.C. §119 to German Patent Application No. 10 2013 018 837.7, filed Nov. 8, 2013, the entirety of which is incorporated herein by reference.

The present invention relates to a grommet strip for a racket for ball games as well as to a specific racket for ball games which is intended for receiving the grommet strip according to the invention.

Rackets for ball games usually comprise a racket frame with a racket head or head portion for receiving strings, as well as a handle portion for holding the racket for ball games. A throat portion comprising a bridge and two arms can be provided between the handle portion and the head portion. The strings are typically formed by a plurality of main strings and cross strings, wherein strictly speaking usually only two long strings (having a length of typically about 6 to 6.5 m) or one very long string (having a length of typically about 11 to 12 m) are/is passed through a plurality of bores in the racket head such that a stringing configuration or pattern of cross strings (portions) and main strings (portions) is formed. The strings are usually passed through grommets which are inserted into the bores in the racket head. Usually, a so-called grommet strip is provided at which a plurality of grommets are attached. In the ready-to-play condition, these grommets pass through the bores in the racket head and the grommet strip forms the circumferential surface area of the racket head.

Even if the stringing configuration of conventional rackets for ball games is relatively uniform in that usually a rectangular pattern of cross strings and main strings is formed, the type of the stringing configuration, i.e. the distances between the individual strings and their arrangement, may have a very considerable influence on the playability of the racket for ball games. Usually, however, a specific stringing type or a specific stringing configuration is assigned to a racket frame, said specific stringing configuration being defined by the arrangement of the bores in the racket head. While attempts to provide a racket for ball games having a variable stringing configuration are known from US 2006/0211526 A1 and DE 10 2006 032 075 A1, these attempts are not very convincing: US 2006/0211526 A1 describes a racket for ball games whose strings can be varied between the conventional pattern of main/cross strings and a diagonal stringing pattern. The stringing configuration of DE 10 2006 032 075 A1 is varied only in the outermost edge of the strings, which at best has a very slight influence on the playability of the racket for ball games.

It is therefore a problem to be solved by the present invention to provide a racket for ball games in which an alternation between two completely different stringing configurations is easily possible. This problem is solved, on the one hand, by a grommet strip according to claims 1 and 11 and, on the other hand, by a racket for ball games according to claim 20. Preferred embodiments of the grommet strip according to the present invention as well as of the racket for ball games according to the present invention are described in the dependent claims.

Accordingly, the present invention is directed to a grommet strip for a racket for ball games which has a longitudinal direction and a plurality of grommets with grommet through-holes. Each of the grommets defines a grommet axis and each of the grommet through-holes defines a hole axis. The grommet axes and the hole axes extend substantially parallel to each other and the hole axes of some grommets are offset with respect to the grommet axes thereof in the longitudinal direction of the grommet strip or along the grommet strip.

The grommet axis is defined via the course of the outer contour of the grommet whereas the hole axis is defined by the grommet through-hole extending in the grommet. In the most simple case of a cylindrical grommet with a cylindrical grommet through-hole, the centre lines of these two cylinders are intended to be offset with respect to each other. The offset preferably amounts to at least 0.2 mm.

The distances between directly adjacent grommet through-holes are preferably essentially the same. Preferably, the distance between directly adjacent grommet through-holes varies by not more than 40%, more preferably by not more than 30% and most preferably by not more than 25% with respect to the smallest distance. A stringing configuration as uniform as possible is generated thereby.

The offset between hole axis and grommet axis is preferably between 0.4 mm and 2 mm, more preferably between 0.8 mm and 1.6 mm and most preferably between 1.1 mm and 1.3 mm.

The grommets of the grommet strip preferably comprise first grommets and second grommets. In the case of the first grommets, the hole axes are offset with respect to the grommet axes in the longitudinal direction of the grommet strip, whereas in the case of the second grommets, the hole axes are not offset with respect to the grommet axes in the longitudinal direction of the grommet strip. The first grommets preferably have a larger extension in the longitudinal direction of the grommet strip than the second grommets. The extension of the first grommets in the longitudinal direction of the grommet strip is preferably larger than the extension of the second grommets in the longitudinal direction of the grommet strip by at least 50%, more preferably by at least 65% and most preferably by at least 80%. In this connection, the extension in the longitudinal direction refers to the largest dimension of the outer contour of the grommets in the longitudinal direction of the grommet strip.

According to a preferred embodiment, the grommet strip comprises at least four and most preferably at least six first grommets. It is further preferred that the grommet strip comprises one or more blind grommets without grommet through-holes. The blind grommets preferably have essentially the same outer dimensions as the second grommets. Preferably, the blind grommets have essentially the same outer contours as the second grommets, i.e. for example the same outer diameter.

The present invention is further directed to a set of at least two grommet strips as described above. The distances between adjacent grommet through-holes of a first grommet strip differ from the distances between adjacent grommet through-holes of a second grommet strip. Preferably, the smallest distance between directly adjacent grommet through-holes of the first grommet strip is larger than the largest distance between directly adjacent grommet through-holes of the second grommet strip. The ratio of the smallest first distance to the largest second distance is preferably at least 1.05, more preferable at least 1.1, even more preferably at least 1.15 and most preferably at least 1.2.

The present invention is further directed to a set of at least two grommet strips comprising a first grommet strip as described above and a second grommet strip, the second grommet strip comprising a plurality of grommets with grommet through-holes and at least one opening, wherein the first grommet strip can be inserted into the opening of the second grommet strip.

The opening preferably has a polygonal shape. The second grommet strip preferably comprises at least 14, more preferably at least 16, even more preferably at least 18 and most preferably at least 20 grommets with grommet through holes. The first grommet strip preferably comprises first grommets and second grommets. In the case of the first grommets, the hole axes are offset with respect to the grommet axes in the longitudinal direction of the grommet strip, whereas in the case of the second grommets, the hole axes are not offset with respect to the grommet axes in the longitudinal direction of the grommet strip. The first grommets preferably have a larger extension in the longitudinal direction of the grommet strip than the second grommets. The extension of the first grommets in the longitudinal direction of the grommet strip is preferably larger than the extension of the second grommets in the longitudinal direction of the grommet strip by at least 50%, more preferably by at least 65% and most preferably by at least 80%. In this connection, the extension in the longitudinal direction refers to the largest dimension of the outer contour of the grommets in the longitudinal direction of the grommet strip. Preferably, the first grommets also have a larger extension along their length (i.e., along their grommet axes) than the second grommets. Preferably, the first grommet strip comprises four first grommets and two second grommets.

The present invention is further directed to a set of at least three grommet strips comprising first and second grommet strips as described above and a third grommet strip, the third grommet strip comprising a plurality of grommets with grommet through-holes and at least one opening, wherein the first or second grommet strip can be inserted into the opening of the third grommet strip and wherein the distances between adjacent grommet through-holes of the first grommet strip differ from the distances between the adjacent grommet through-holes of the second grommet strip.

The present invention is further directed to a set of a racket for ball games and at least two grommet strips or two sets of grommet strips as described above, wherein the distances between adjacent grommet through-holes of a first grommet strip differ from the distances between the adjacent grommet through-holes of a second grommet strip and wherein the racket for ball games is configured to accommodate alternatively or alternately one of the at least two grommet strips.

The invention is based on the idea of varying the stringing configuration of a racket for ball games in a simple way in that different grommet strips are provided for one and the same racket for ball games. Said racket for ball games has a plurality of fixedly installed bores or holes for accommodating grommets. The outer contour of the grommets of the first grommet strip and of the grommets of the second grommet strip as well as their arrangement is essentially the same so that both grommet strips can be attached to the racket for ball games or rather to the racket head of the racket for ball games in such a way that the grommets of the respective grommet strip are accommodated in the bores in the racket head. However, since the grommet through-holes are offset with respect to the grommet axes in the longitudinal direction of the grommet strip, the course of the strings in the strung racket for ball games does not exactly correspond to the arrangement of the bores but is offset with respect thereto. The stringing configuration of the racket for ball games can be varied in this way by the provision of different grommet strips with different offset. This variation can be further supported, i.a., in that the first and second grommet strips have blind grommets at different locations so that a real grommet with a grommet through-hole in the first strip is replaced by a blind grommet in the second strip and vice versa. In the same way, some bores in the racket head are not used by a string but are "deactivated" by means of blind grommets when a specific grommet strip is used.

It is further preferred that the offset in the longitudinal direction in the first grommet strip is arranged in a substantially mirror-inverted way with respect to that in the second grommet strip: In other words, when proximal and distal ends are assigned to the grommet strip and the hole axis of a specific grommet of the first grommet strip is offset with respect to the grommet axis in the direction of the proximal end, the hole axis of the corresponding grommet of the second grommet strip is preferably offset in the direction of the distal end and vice versa.

According to a further preferred embodiment of the present invention, the above discussed alternation between the stringing configurations can be accomplished not only by exchanging the grommet strip but also by differently stringing one and the same grommet strip. Accordingly, the present invention is also directed to a grommet strip for a racket for ball games which comprises a longitudinal direction and a plurality of grommets. The grommets form a first set of grommet through-holes for a first stringing configuration of the racket for ball games and a second set of grommet through-holes for a second stringing configuration of the racket for ball games. The distances between directly adjacent grommet through-holes of the first set vary by not more than 50% with respect to the smallest distance of the first set. The distances between directly adjacent grommet through-holes of the second set vary by not more than 50% with respect to the smallest distance of the second set. In this case, the first stringing configuration differs from the second stringing configuration. In other words, when the strings extend through the through-holes of the first set, their arrangement differs from that which is obtained when they extend through the through-holes of the second set. In particular, the distances of the first set do not correspond to those of the second set (in addition to the fact that the number of the distances may be different).

The distances between directly adjacent grommet through-holes of the first set preferably vary by not more than 40%, more preferably by not more than 30% and most preferably by not more than 25% with respect to the smallest distance of the first set. The distances between directly adjacent grommet through-holes of the second set preferably vary by not more than 40%, more preferably by not more than 30% and most preferably by not more than 25% with respect to the smallest distance of the second set. Preferably, the smallest distance between directly adjacent grommet through-holes of the first set is larger than the largest distance between directly adjacent grommet through-holes of the second set. Preferably, the smallest distance of the first set is 5%, more preferably at least 10% and most preferably at least 15% larger than the largest distance of the second set.

Preferably, the grommets comprise first grommets having two grommet through-holes each and second grommets having one grommet through-hole each. The first set of grommet through-holes is preferably formed of first and second grommets and the second set of grommet through-holes is preferably also formed of first and second grommets. Preferably, each grommet through-hole is either part of the first set of grommet through-holes or part of the second set of grommet through-holes. Accordingly, each of the second grommets preferably belongs to only one stringing configuration whereas each of the first grommets preferably is part of the first and second stringing configurations via its first and second grommet through-holes respectively.

Preferably, the grommet strip comprises at least four and most preferably at least six first grommets. Preferably, the grommet strip comprises at least seven second grommets. Some of the first grommets are preferably arranged so as to be directly adjacent to each other and/or some of the second grommets are arranged so as to be directly adjacent to each other.

The present invention is further directed to a racket for ball games comprising a grommet strip as described above.

The present invention is further directed to a racket for ball games which can accommodate one or more of the above described grommet strips. The racket for ball games has a racket head for accommodating strings, wherein the racket head comprises a plurality of first and a plurality of second bores in each of the areas between one o'clock and five o'clock and between seven o'clock and eleven o'clock for accommodating grommets. The first bores have a larger extension in the circumferential direction of the racket head than the second bores. The distance between directly adjacent bores in the area between one o'clock and five o'clock and in the area between seven o'clock and eleven o'clock varies by at least 40% with respect to the smallest distance. The distance is directed to the distance between the centres (in the case of circular bores) or between the balance points (in the case of non-circular bores).

The distance between directly adjacent bores preferably varies in the area between one o'clock and five o'clock and in the area between seven o'clock and eleven o'clock by at least 50%, more preferably by at last 60% and most preferably by at least 70% with respect to the smallest distance. According to a preferred embodiment, the bores according to the invention are arranged in the area between two o'clock and four o'clock and in the area between eight o'clock and ten o'clock.

The extension of the first bores in the circumferential direction of the racket head is preferably larger than the extension of the second bores in the circumferential direction of the racket head by at least 50%, more preferably by at least 65% and most preferably by at least 80%.

Preferably at least four and more preferably at least six first bores are provided in each of the areas between one o'clock and five o'clock and between seven o'clock and eleven o'clock.

The smallest distance between directly adjacent bores preferably is smaller than 8 mm, more preferably smaller than 7 mm and most preferably smaller than 6 mm.

Preferably at least two first bores are arranged so as to be directly adjacent to each other and at least two second bores are arranged so as to be directly adjacent to each other. The distance between directly adjacent first bores is preferably larger than the distance between directly adjacent second bores.

The present invention is further directed to a racket for ball games as described above, comprising one of the grommet strips described above.

The grommet strips according to the invention as well as the racket for ball games according to the invention make it possible that the racket for ball games can be very easily strung with different stringing configurations. To this end, defined bores are provided in the racket for ball games which enable the accommodation of specific grommet strips. The alternation between the stringing configurations is accomplished depending on the respective embodiment either by alternating between different grommet strips or by differently stringing one and the same grommet strip while omitting some of the grommet through-holes.

Preferred embodiments of the present invention are described in the following in more detail with reference to the Figures.

Figure 1:
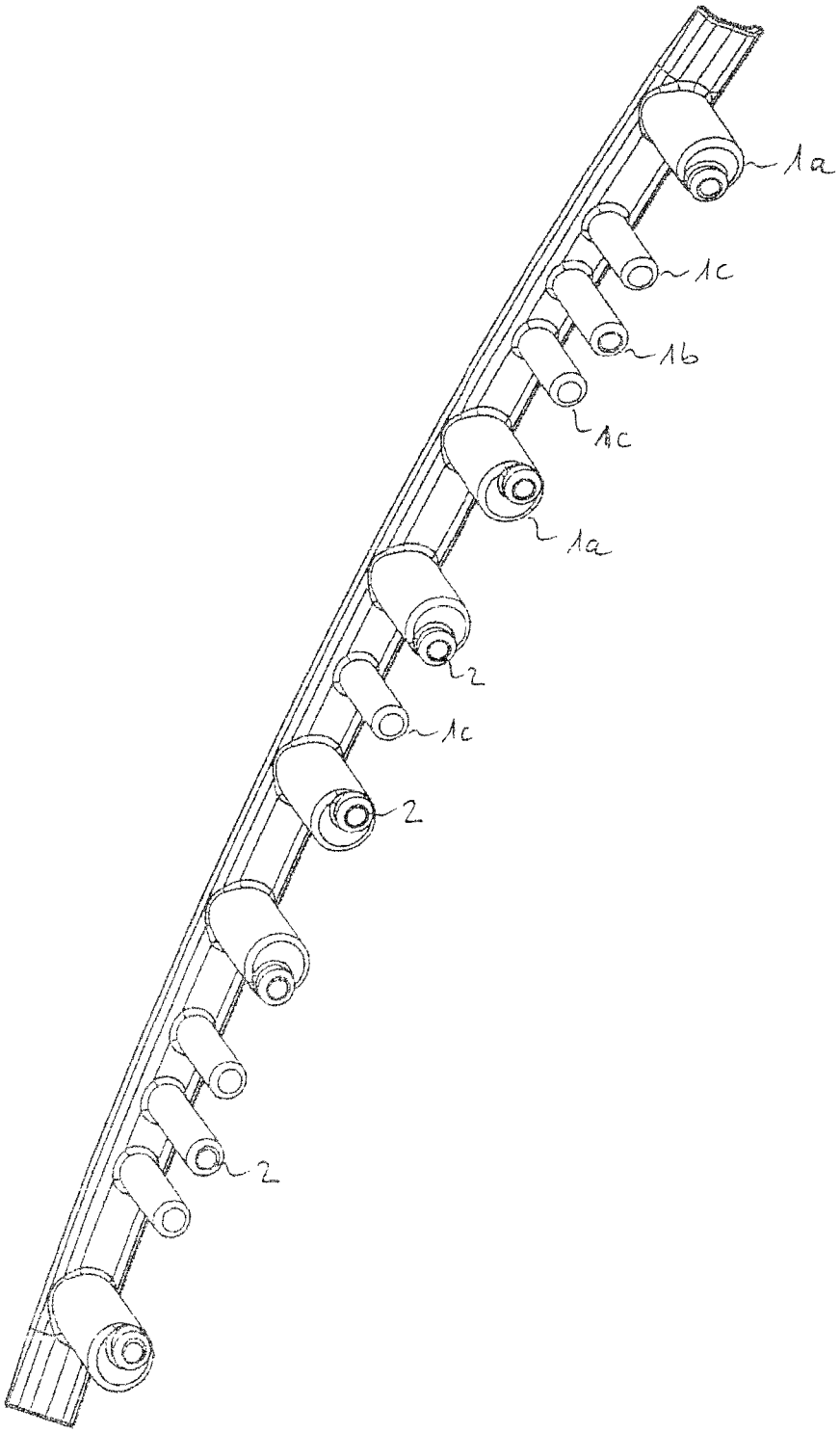
FIG. 1 shows a perspective view of a grommet strip according to a first preferred embodiment.
Figure 2:
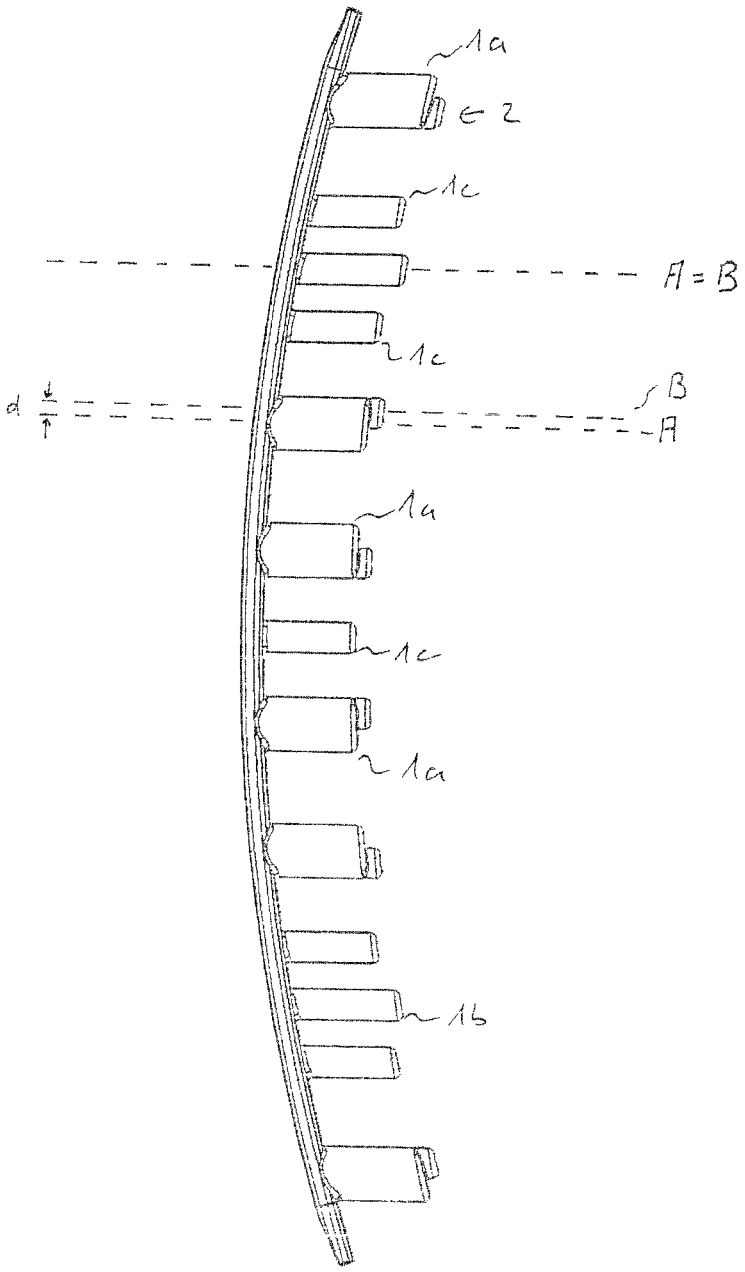
FIG. 2 shows a side view of the grommet strip according to FIG. 1.
Figure 3:
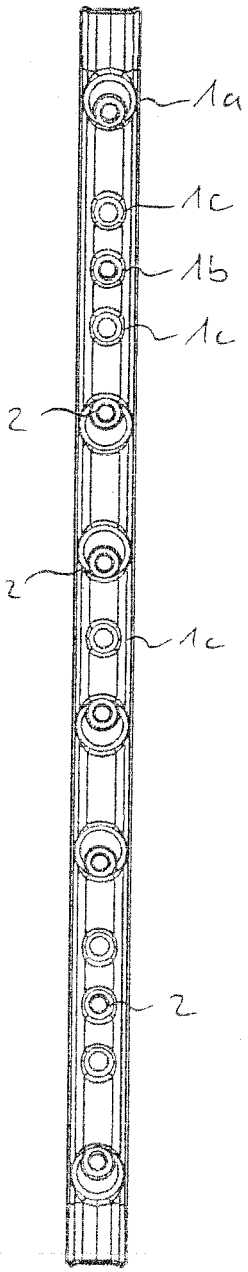
FIG. 3 shows a top view of the grommet strip according to FIG. 1.
Figure 4:
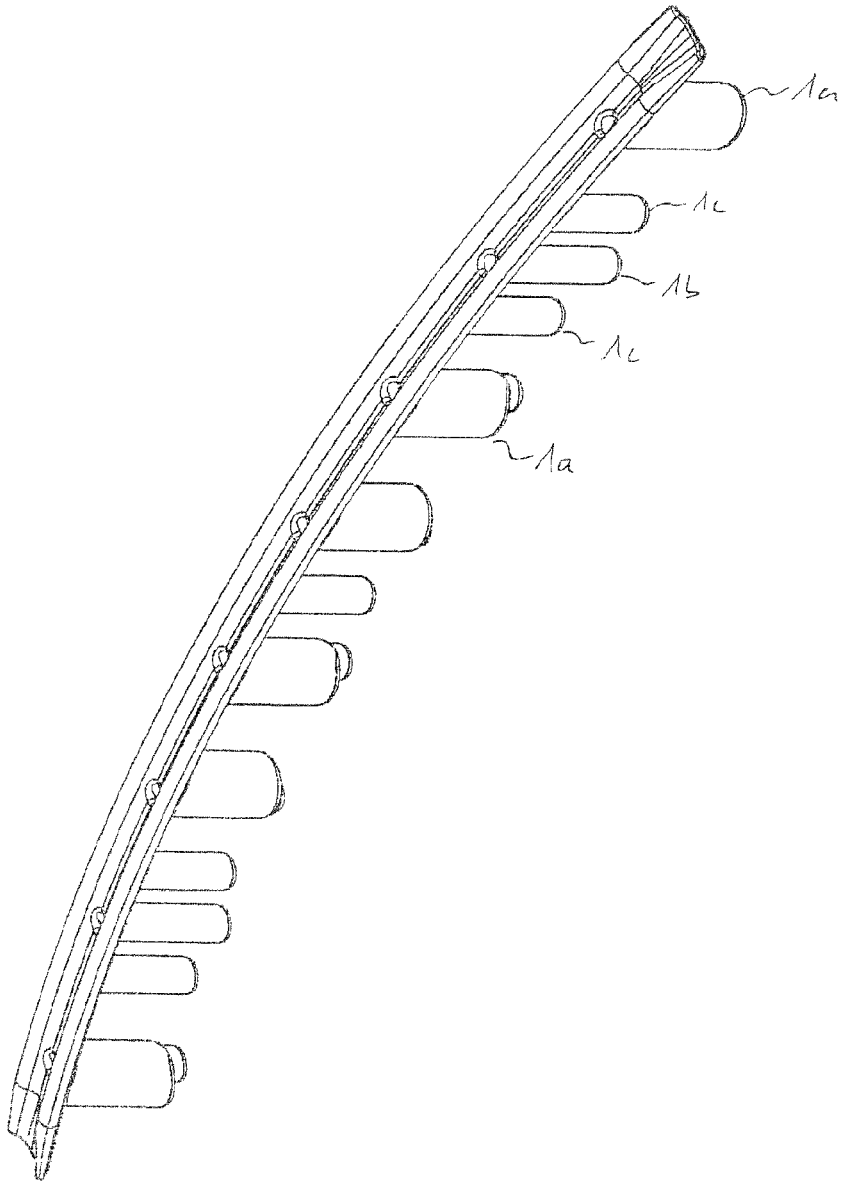
FIG. 4 shows a further perspective view of the grommet strip according to FIG. 1.
Figure 5:
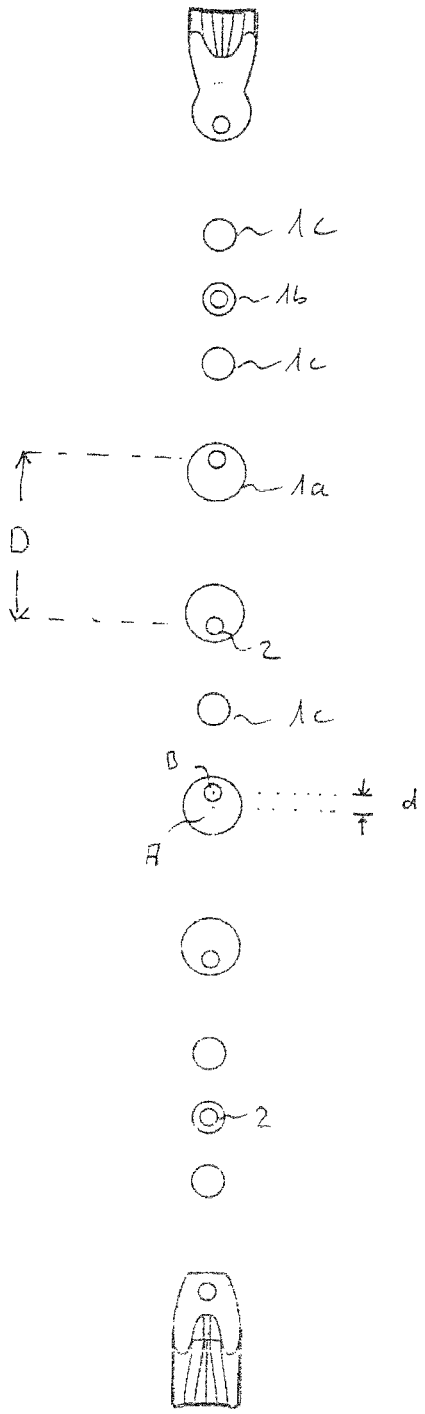
FIG. 5 shows a cross-section through the grommet strip according to FIG. 1.

FIGS. 1 to 5 illustrate a grommet strip for a racket for ball games according to a first preferred embodiment of the present invention. The grommet strip has a slightly curved longitudinal direction—corresponding to the outer contour of a respective racket for ball games—and comprises a plurality of grommets 1 having grommet through-holes 2. Each of the grommets 1 defines a grommet axis A (cf. FIG. 2) and each of the grommet through-holes 2 defines a hole axis B. The grommet axes A and the hole axes B extend substantially parallel to each other. The hole axes B of some grommets 1 are offset with respect to the grommet axes A thereof in the longitudinal direction of the grommet strip. As can be seen in FIG. 2, this means that there is an offset along the longitudinal contour of the grommet strip. The grommet strip further comprises grommets in which the grommet axis A is essentially identical to the hole axis B, as can be likewise seen in FIG. 2.

The distance D between directly adjacent grommet through-holes 2 (cf. FIG. 5) varies by not more than 40%, preferably by not more than 30% and most preferably by not more than 25% with respect to the smallest distance between directly adjacent grommet through-holes. The offset d between the grommet axis A and the hole axis B in the longitudinal direction is preferably between 0.4 mm and 2 mm, more preferably between 0.8 mm and 1.6 mm and most preferably between 1.1 mm and 1.3 mm.

As depicted in FIGS. 1 to 5, the grommet strip preferably comprises first grommets 1*a*, wherein the hole axes B are offset with respect to the grommet axes A in the longitudinal direction of the grommet strip, and second grommets 1*b*, wherein the hole axes B are not offset with respect to the grommet axes A in the longitudinal direction of the grommet strip. In the illustrated preferred embodiment, the first grommets 1*a* have a larger extension in the longitudinal direction of the grommet strip than the second grommets 1*b*. It is thus possible to achieve an offset d as large as possible in the case of the first grommets 1*a* without making the second grommets 1*b* unnecessarily large.

In the illustrated preferred embodiment, six first grommets 1*a* and two grommets 1*b* are provided. Furthermore, five blind grommets 1*c* are provided, which do not have grommet through-holes 2. This can be seen particularly clearly in the sectional view of FIG. 5. The blind grommets have essentially the same outer dimensions or the same geometry as the second grommets 1*b*. However, as depicted in FIG. 2, the blind grommets 1*c* may be configured somewhat shorter that the second grommets 1*b*.

Figure 6:
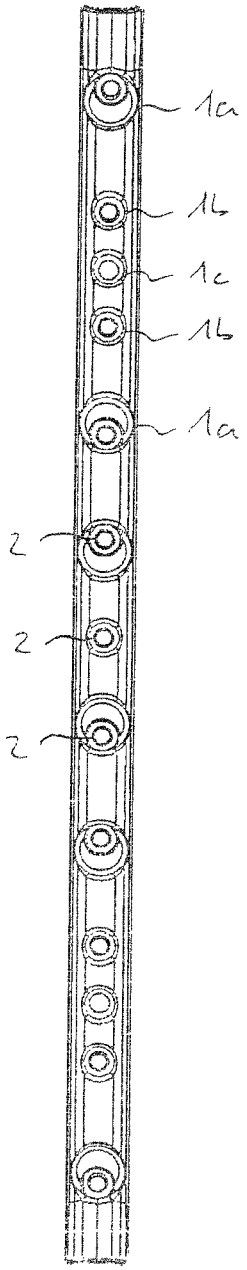
FIG. 6 shows a top view of a grommet strip according to a second preferred embodiment.
Figure 7:
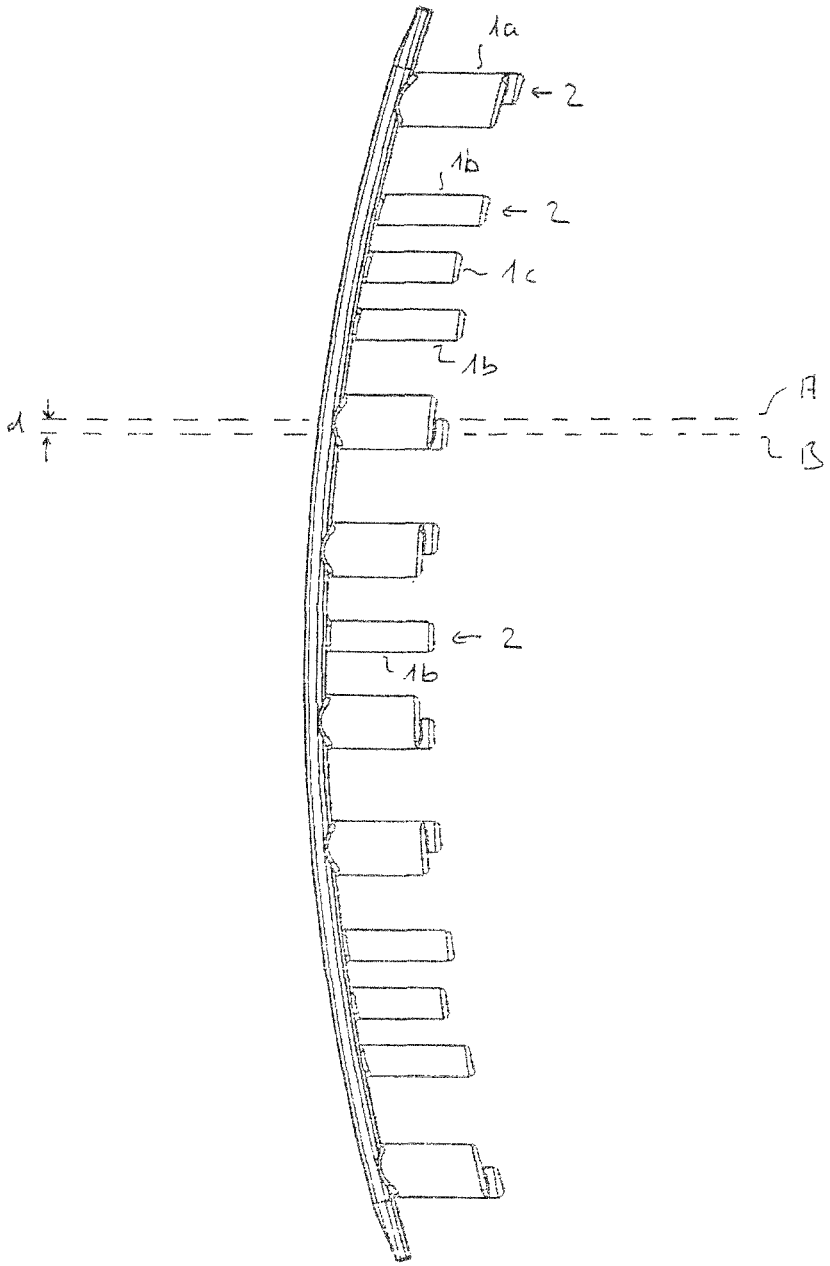
FIG. 7 shows a side view of the grommet strip according to FIG. 6.
Figure 8:
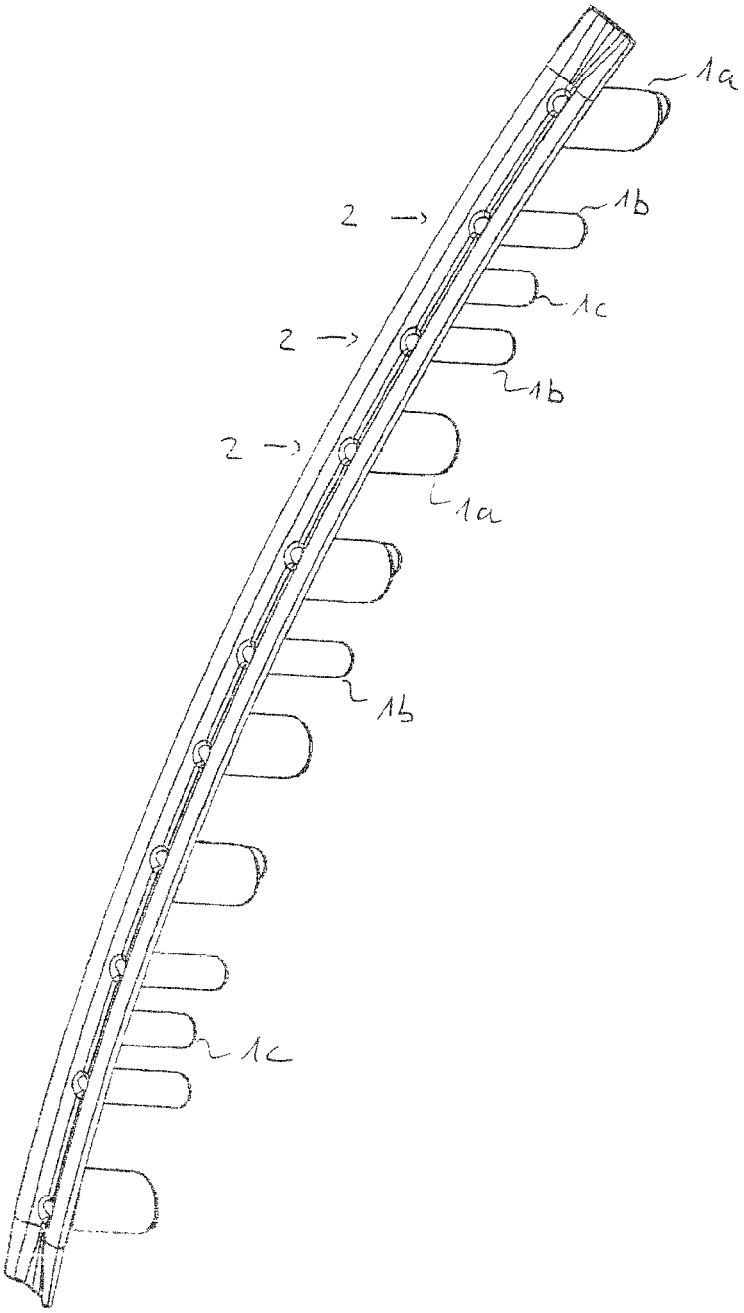
FIG. 8 shows a perspective view of the grommet strip according to FIG. 6.

In FIGS. 6 to 8, a grommet strip according to a second preferred embodiment is shown, which corresponds to the grommet grip according to the first preferred embodiment. This grommet strip, too, comprises first grommets 1*a*, second grommets 1*b* and blind grommets 1*c*; but the distances between the adjacent grommet through-holes 2 of the grommet strip according to FIGS. 6 to 8 differ from the distances between adjacent grommet through-holes 2 of the grommet strip according to FIGS. 1 to 5. In the two depicted embodiments this is made possible in two ways: on the one hand, the offset between grommet axis A and hole axis B in the case of the second embodiment is arranged in a mirror-inverted way with respect to the first embodiment, as is revealed by a comparison of FIGS. 2 and 7. In the case of the first grommet strip (FIG. 2), the hole axis B is offset with respect to the hole axis A towards the top whereas in the case of the second grommet strip (FIG. 7), the hole axis B is offset with respect to the grommet axis A toward the bottom. Since the course of the string in the strung racket for ball games is essentially determined by the arrangement of the hole axis B, this entails that, when the grommet strip according to FIG. 2 is used, the string extends further at the top in the racket for ball games than in the case when the grommet strip according to FIG. 7 is used.

On the other hand, the position of second grommets 1*b* and blind grommets 1*c* has been interchanged between the grommet strips of FIGS. 2 and 7: at positions where in the case of FIG. 2 a second grommet 1*b* is arranged, there is in the case of FIG. 7 a blind grommet 1*c* and vice versa. The latter entails not only an additional offset of the strings but also a modification in the total number of strings in the strung racket for ball games: while the grommet strip according to FIGS. 1 to 5 comprises a total of eight grommet through-holes 2, a total of eleven grommet through-holes 2 are provided in the grommet strip according to FIGS. 6 to 8.

Figure 11:
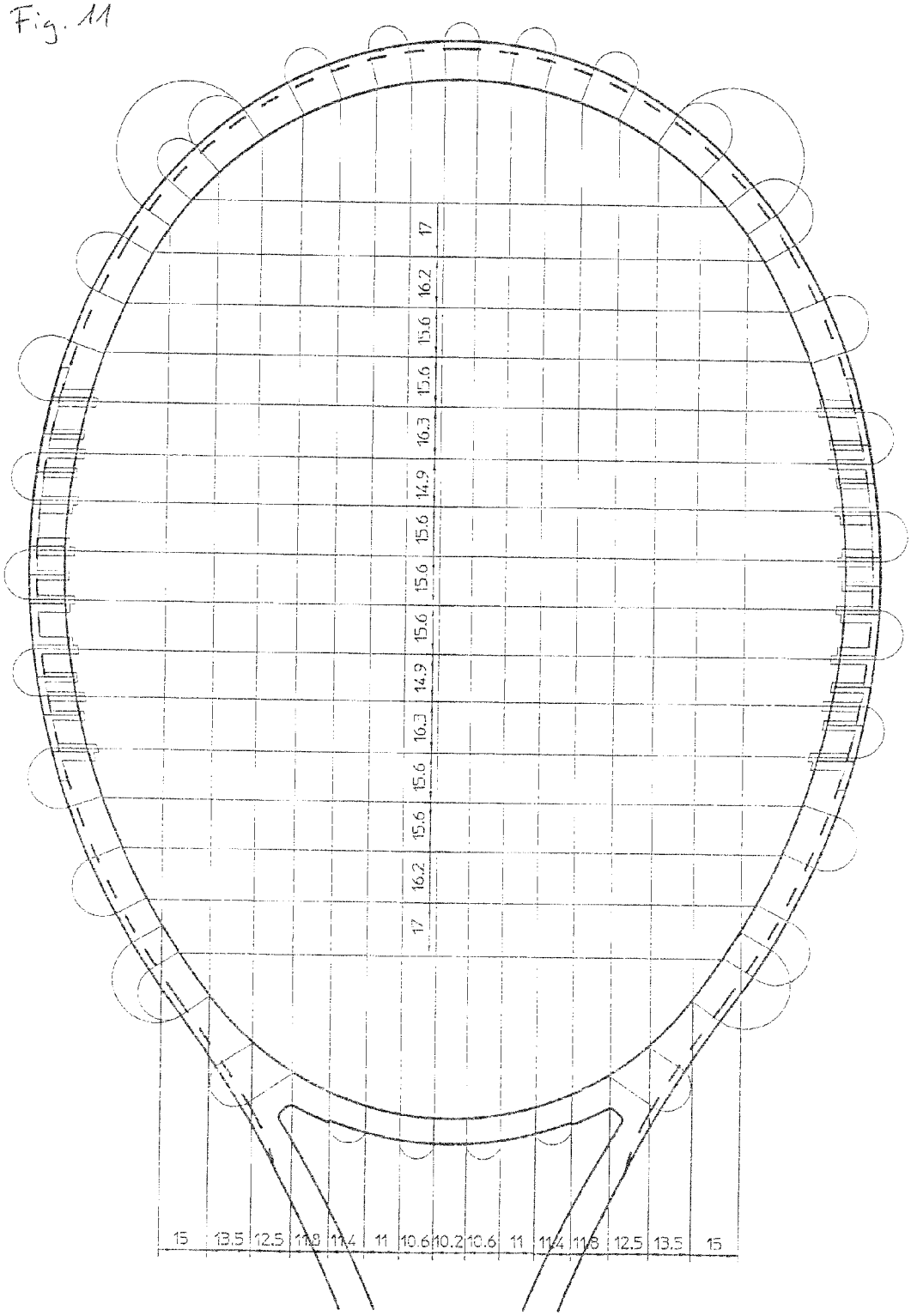
FIG. 11 shows a top view of a tennis racket comprising two grommet strips according to FIG. 1.
Figure 12:
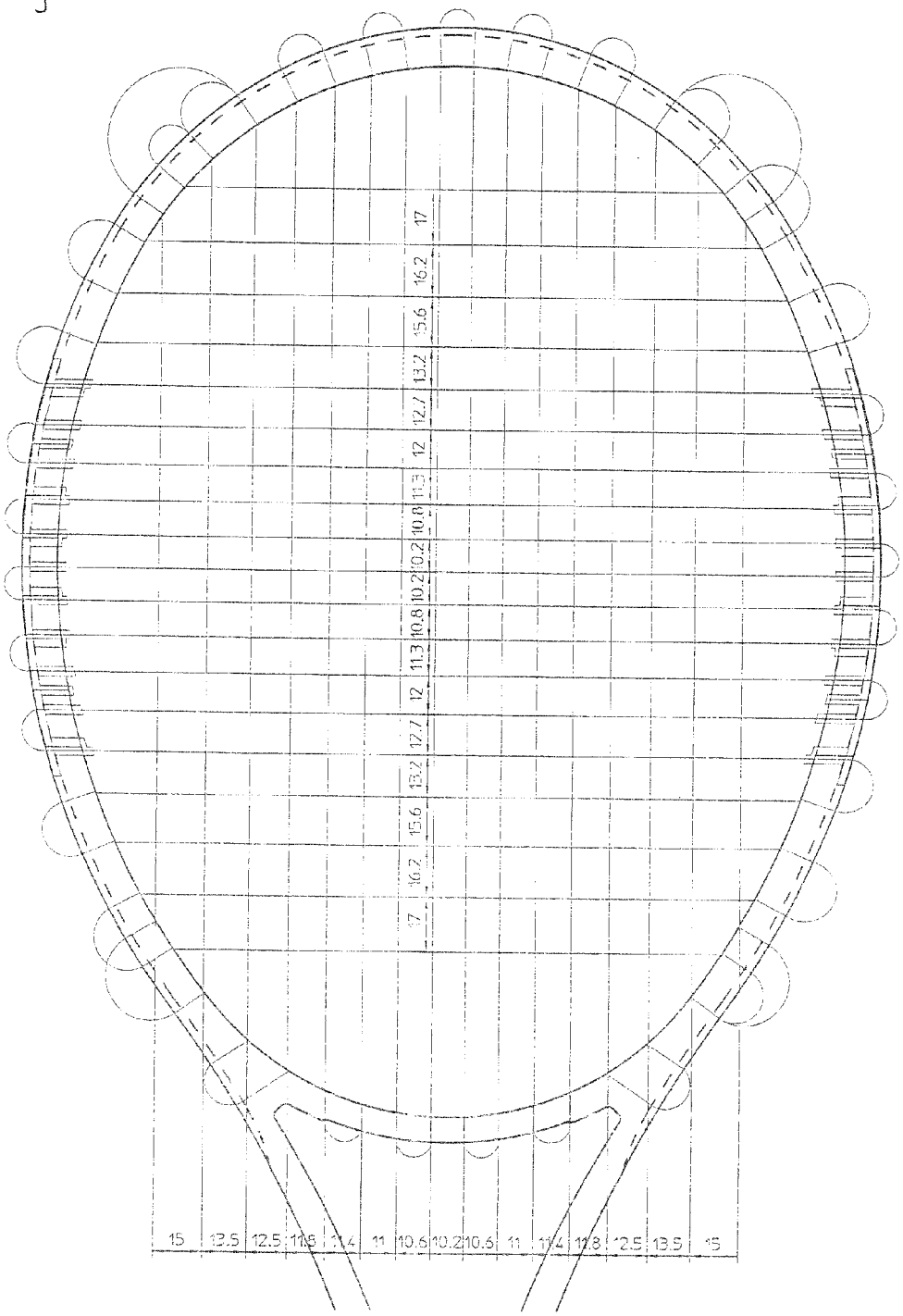
FIG. 12 shows a top view of a tennis racket according to FIG. 11, comprising two grommet strips according to FIG. 6.

Each of FIGS. 11 and 12 shows a top view of a tennis racket, wherein in one case two grommet strips according to FIGS. 1 to 5 (FIG. 11) and in the other case two grommet strips according to FIGS. 6 to 8 (FIG. 12) are attached to one and the same tennis racket. Both tennis rackets are strung with cross and main strings, wherein the course of the strings through the grommet through-holes and in particular along the outer contour of the racket head is schematically illustrated by means of circular arcs.

As revealed by a comparison of FIGS. 11 and 12, the stringing pattern of the cross strings varies quite considerably in particular in the middle area of the racket head. The distances between adjacent cross strings in the case of a preferred embodiment are indicated by way of example only. These very concrete distances, of course, are not to be considered as limiting. It can be seen, however, that by means of the grommet strip according to FIGS. 1 to 5 all in all considerably larger distances between adjacent cross strings are obtained than in the case of using the grommet strip according to FIGS. 6 to 8. Furthermore, the strings of FIG. 11—corresponding to the above discussed different number of grommet through-holes in the two grommet strips—comprise a different total number of cross strings.

When different grommet strips are used, the stringing configuration is achieved by means of a different sequence of first grommets 1*a* and seconds grommets 1*b*, as apparent from FIGS. 11 and 12: In the case of the grommet strip according to FIGS. 1 to 5, this sequence reads: 1*a*-1*b*-1*b*-1*a*-1*a*-1*a*-1*a*-1*b*-1*a*. The sequence in the case of the grommet strip according to FIGS. 6 to 8, in contrast, reads as follows: 1*a*-1*b*-1*a*-1*a*-1*b*-1*a*-1*a*-1*b*-1*b*-1*a*. Accordingly, the grommet strips of both preferred embodiments comprise two pairs of directly adjacent first grommets 1*a* each. In the case of the embodiment of FIGS. 1 to 5, however, a blind grommet 1*c* is arranged between the two pairs, whereas the string in the case of the grommet strip of FIGS. 6 to 8 passes through a second grommet 1*b* between these two pairs. Besides, in the case of the embodiment of FIGS. 6 to 8, the two grommet through-holes 2 of each pair are offset towards each other, whereas, in the case of the embodiment of FIGS. 1 to 5, the grommet through-holes 2 of the two pairs are offset away from each other.

The two grommet strips are configured such that they can be alternatively inserted into the bores of one and the same tennis racket or racket for ball games. To this end, it is particularly preferred that the outer diameter of the grommets of both grommet strips is essentially the same. It is further preferred that the arrangement of the grommets and the distances between them (in contrast to the distances between the grommet through-holes) are essentially the same for both grommet strips. Geometric deviations may at best be provided at the ends of the grommets facing the strings, as apparent from the Figures: The blind grommets 1*c* may be shorter than the second grommets 1*b*.

First of all, the present invention is directed to an individual grommet strip as illustrated, for example, in FIGS. 1 to 5 or in FIGS. 6 to 8. Furthermore, the present invention is directed to a combination of two different grommet strips, for example, a combination of the grommet strip according to FIGS. 1 to 5 with the grommet strip according to FIGS. 6 to 8. Such a combination of a first grommet strip with a second grommet strip enables a racket for ball games to be alternatively strung so as to have a first stringing configuration and a second stringing configuration. Preferably, the distance between directly adjacent grommet through-holes within one grommet strip varies by not more than 50%, more preferably by not more than 40%, even more preferably by not more than 30% and most preferably by not more than 25%. The smallest distance between directly adjacent grommet through-holes of the one grommet strip is preferably larger than the largest distance between directly adjacent grommet through-holes of the second grommet strip. The ratio of the smallest first distance to the largest second distance is preferably at least 1.05, more preferably at least 1.1 and even more preferably at least 1.15 and most preferably at least 1.2.

The present invention further relates to a set of a racket for ball games and at least two grommet strips, wherein the distances between adjacent grommet through-holes of a first grommet strip differ from the distances between adjacent grommet through-holes of a second grommet strip, and wherein the racket for ball games is configured to accommodate alternatively or alternately one of the at least two grommet strips.

Figure 9:
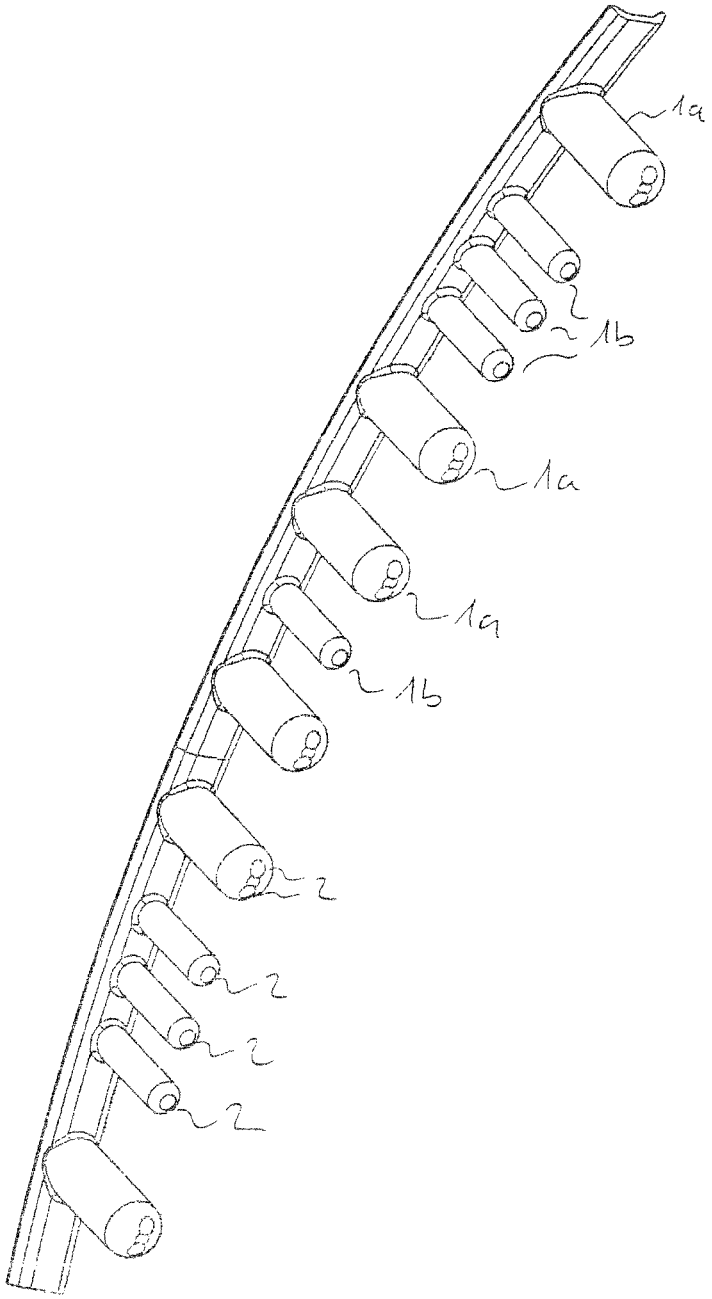
FIG. 9 shows a perspective view of a grommet strip according to a third preferred embodiment.
Figure 10:
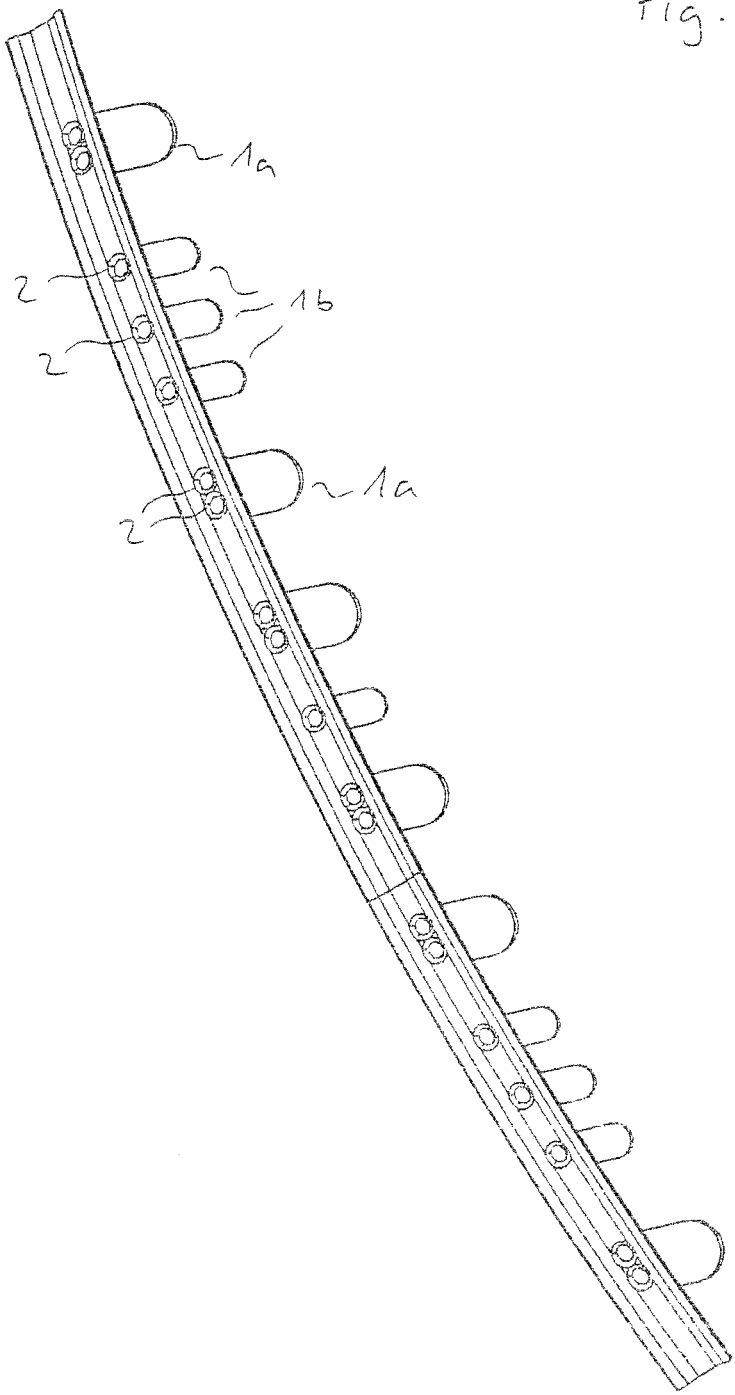
FIG. 10 shows a further perspective view of the grommet strip according to FIG. 9.

In FIGS. 9 and 10, a grommet strip according to a third preferred embodiment is illustrated. The grommet strip of this preferred embodiment comprises six first grommets 1*a* and seven second grommets 1*b*, wherein each of the first grommets 1*a* has two grommet through-holes 2 and each of the second grommets 1*b* has one grommet through-hole 2. The grommet through-holes 2 of the second grommets 1*b* are preferably arranged substantially concentrically with the grommets. The grommet through-holes 2 of the first grommets 1*a* are provided with an offset with respect to the grommet axes thereof in the longitudinal direction between 0.4 mm and 2 mm, more preferably between 0.8 mm and 1.6 mm and most preferably between 1.1 mm and 1.3 mm. Accordingly, the two grommet through-holes 2 of one and the same first grommet 1*a* preferably have a distance to each other of between 0.8 mm and 4 mm, more preferably between 1.6 mm and 3.2 mm and most preferably between 2.2 mm and 2.6 mm.

Two different stringing configurations can be generated with a grommet strip according to FIGS. 9 and 10 without the grommet strip having to be exchanged. Instead, only one of the two through-holes 2 of each of the first grommets 1*a* is traversed by a string in the first stringing configuration and the respectively other of the two grommet through-holes in the second stringing configuration. Additionally, in each of the two different stringing types only some of the second grommets 1*b* are used. As readily understood by the person skilled in the art, exactly the stringing configurations of FIGS. 11 and 12 can be achieved by means of the grommet strip of FIGS. 9 and 10 in that in each case respectively appropriate grommet through-holes are traversed by strings.

The embodiment of FIGS. 9 and 10 is particularly advantageous in that in this embodiment an alternation of the stringing configuration can be achieved without interchanging the grommet strip. The advantage of the embodiment according to FIGS. 1 to 8 consists in that a wrong stringing result is avoided because the player or the person performing the stringing operation only has to use all of the grommet through-holes, whereas the grommet strip according to FIGS. 9 and 10 requires a well-directed selection of specific grommet through-holes.

The present invention is further directed to a racket for ball games comprising a racket head for accommodating strings, wherein the racket head comprises a plurality of first and a plurality of second bores in each of the areas between one o'clock and five o'clock and between seven o'clock and eleven o'clock for accommodating grommets. The first bores have a larger extension in the circumferential direction of the racket head than the second bores and the distance between directly adjacent bores in the area between one o'clock and five o'clock and in the area between seven o'clock and eleven o'clock varies by at least 40% with respect to the smallest distance. Even if the bores of the racket for ball games according to the present invention are only schematically illustrated in FIGS. 11 and 12, it should be clear to the person skilled in the art that the arrangement and shape of these bores are intended to be substantially complementary to the arrangement and shape of the grommet strips of FIGS. 1 to 9. As regards the case of the particularly preferred embodiment illustrated here, this means, for example, that six first bores and seven second bores are provided, wherein two pairs of directly adjacent first bores are provided. There is an individual second bore between these two pairs of first bores. Furthermore, two groups of three directly adjacent second bores per group are provided. The smallest distance of directly adjacent bores is preferably less than 8 mm and more preferably less than 7 mm and most preferably less than 6 mm. It is further preferred that the distance between directly adjacent first bores is larger than the distance between directly adjacent second bores.

Figure 13:
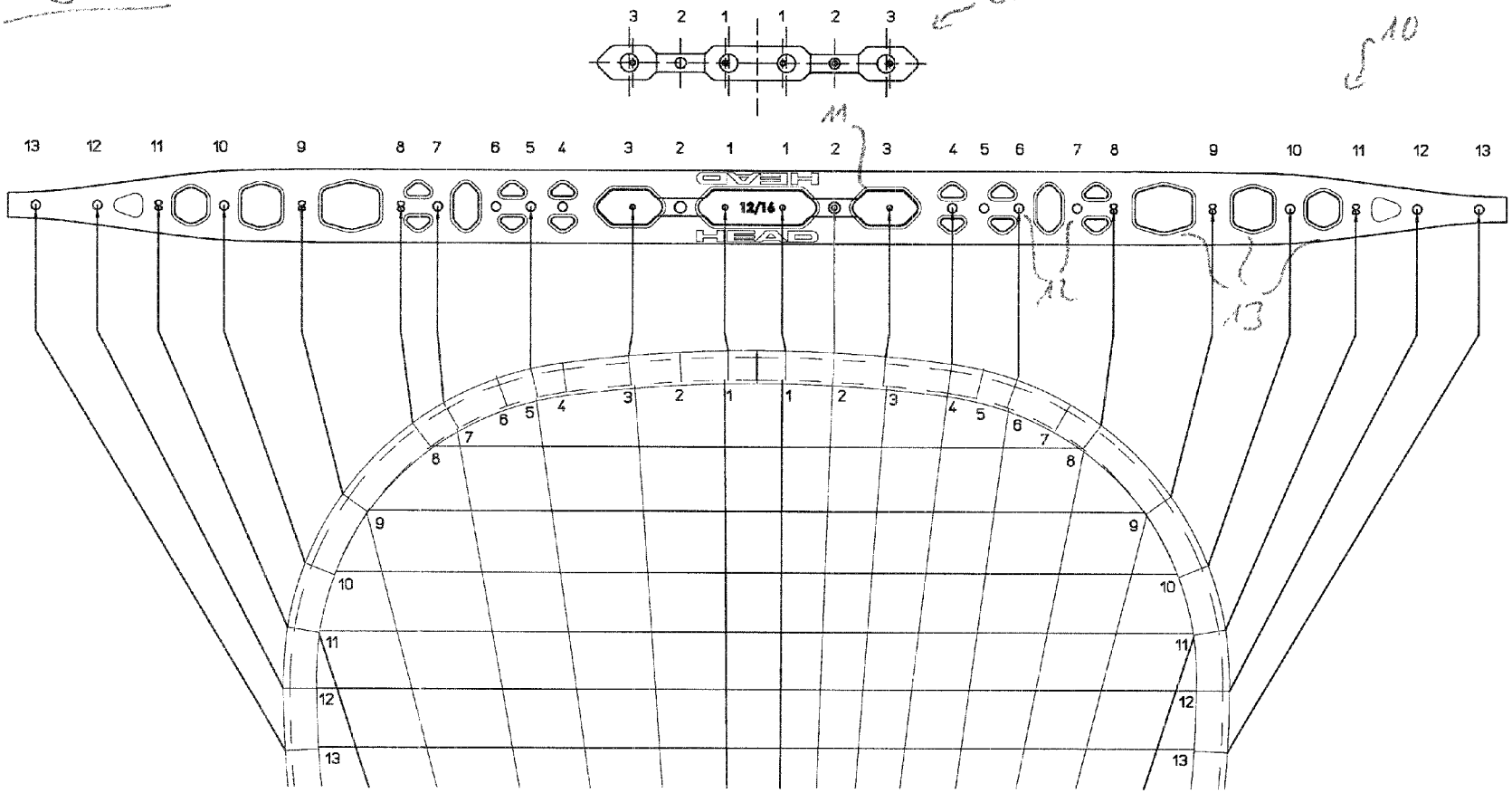
FIG. 13 shows a top view of an upper portion of a racquet ball racket and two grommet strips for said racket.
Figure 14:
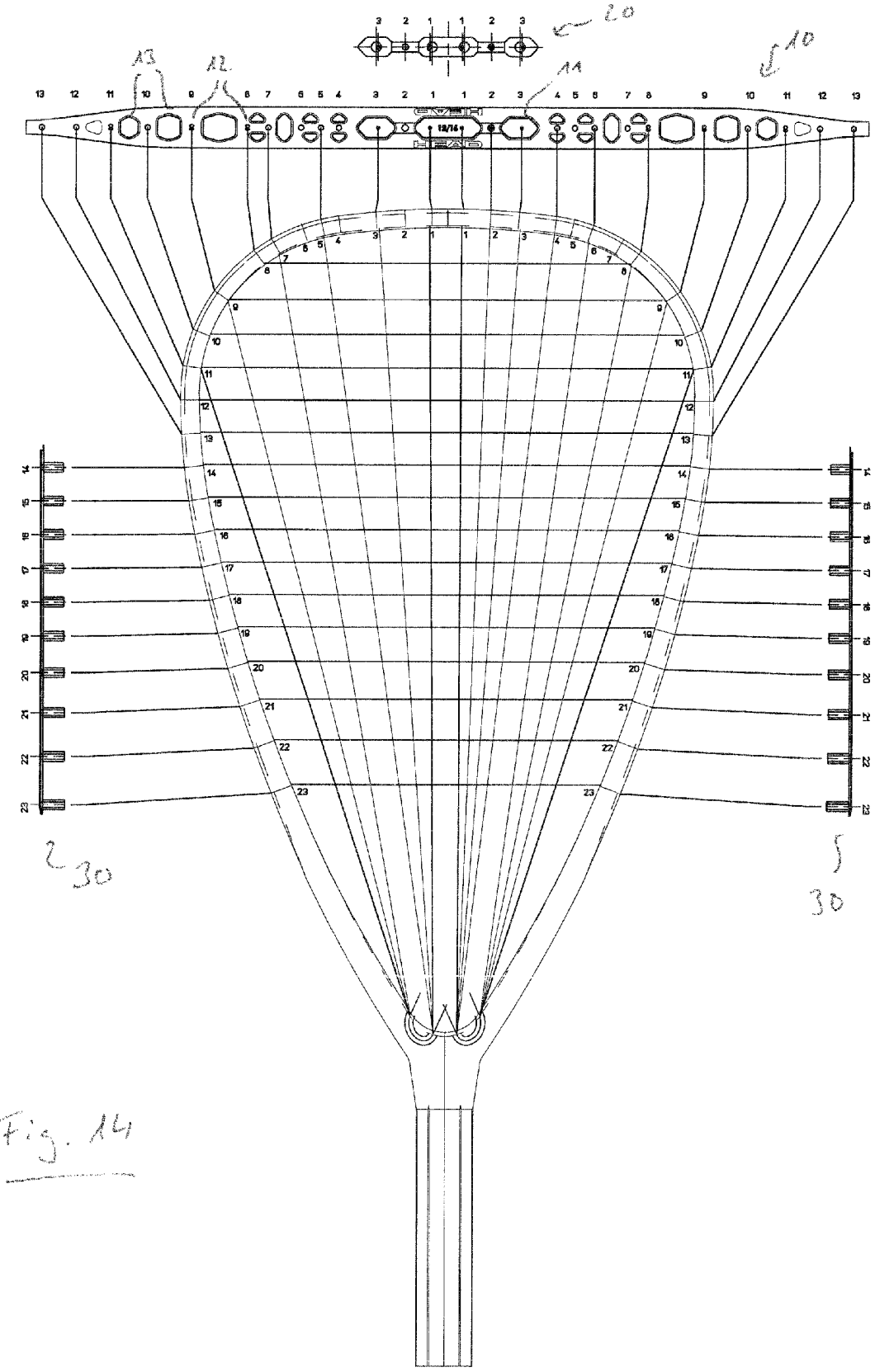
FIG. 14 shows a top view of an the entire racquet ball racket of FIG. 13 and four grommet strips for said racket.

FIG. 14 shows a top view of a racquet ball racket according to a preferred embodiment of the present invention. Even though FIG. 14 shows a racquet ball racket it should be evident that the inventive features shown in FIG. 14 (as well as those of FIGS. 13 and 15 to 18) may also be employed in any other racket type. FIG. 13 shows an upper portion of the racket shown in FIG. 14.

The racket comprises or may be equipped with inventive grommet strips 10 and 20 as well as two regular grommet strips 30. The grommet strips 10 and 20 form a set of two grommet strips comprising a first grommet strip 20 and a second grommet strip 10, the second grommet strip 10 comprising a plurality of grommets 12 with grommet through-holes and at least one opening 11, wherein the first grommet strip 20 can be inserted into the opening 11 of the second grommet strip 10. The second grommet strip 10 further comprises a number of optional openings 13 which are provided in order to reduce the total weight of the grommet strip 10.

The second grommet strip 10 comprises more grommets 12 with grommet through holes than necessary for a typical stringing of, e.g., a racquet ball racket. In the embodiment shown in FIGS. 13 and 14, the grommet strip 10 comprises 20 grommets 12 even though only 16 grommets are being used for a particular stringing pattern. However, the excess amount of grommets may be used to provide two different stringing configurations as indicated in FIGS. 13 and 14, wherein the right half of the racket is provided with a first stringing configuration and the left half of the racket is provided with a second stringing configuration. It is needless to say that this is for illustrative purposes only, whereas in real life the entire racket would be provided with either the first or the second stringing configuration so as to provide a symmetric stringing.

The grommets 12 of the second grommet strip 10 are consecutively numbered from 4 through 13. Yet, in the right half of the racket only grommet numbers 4, 6 and 8 to 13 are used for strings to pass therethrough. By contrast, in the left half of the racket only grommet numbers 5 and 7 to 13 are used for strings to pass therethrough. As is evident from FIGS. 13 and 14 the use of different grommets 12 leads to a visible change in the stringing configuration.

Figure 15:
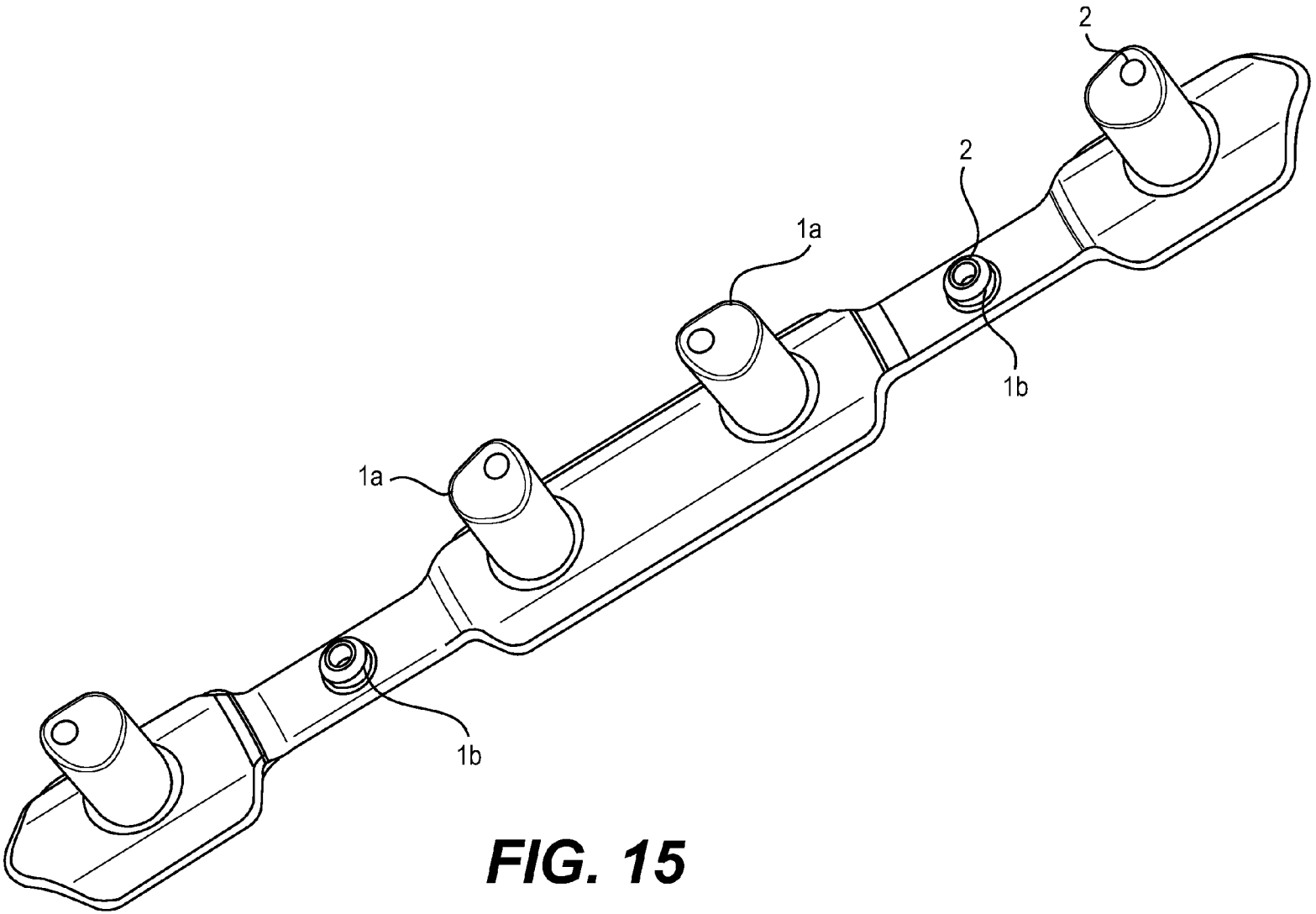
FIG. 15 shows a perspective view of a grommet strip according to a fourth preferred embodiment.
Figure 16:
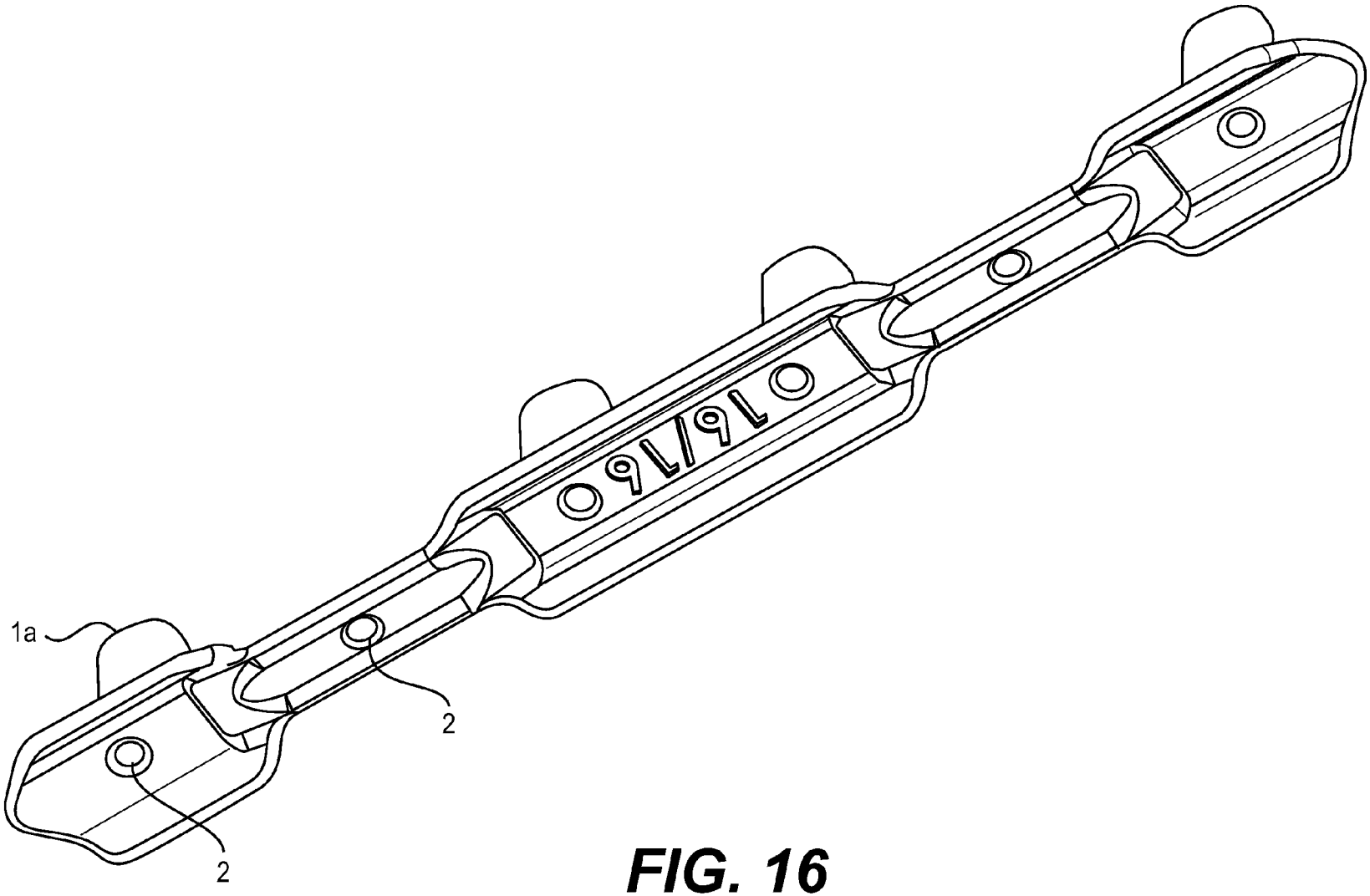
FIG. 16 shows a further perspective view of the grommet strip according to FIG. 15.
Figure 17:
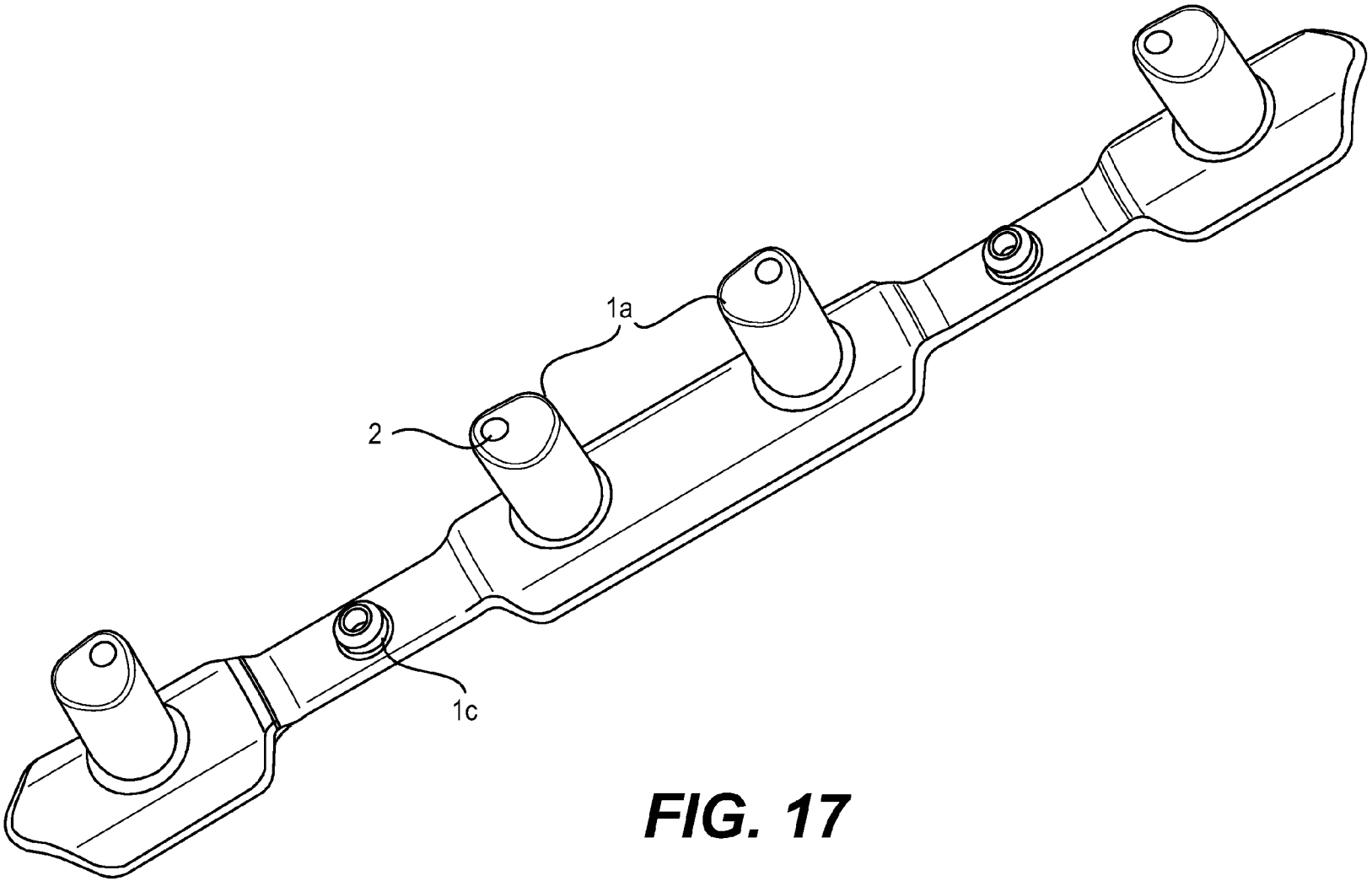
FIG. 17 shows a perspective view of a grommet strip according to a fifth preferred embodiment.
Figure 18:
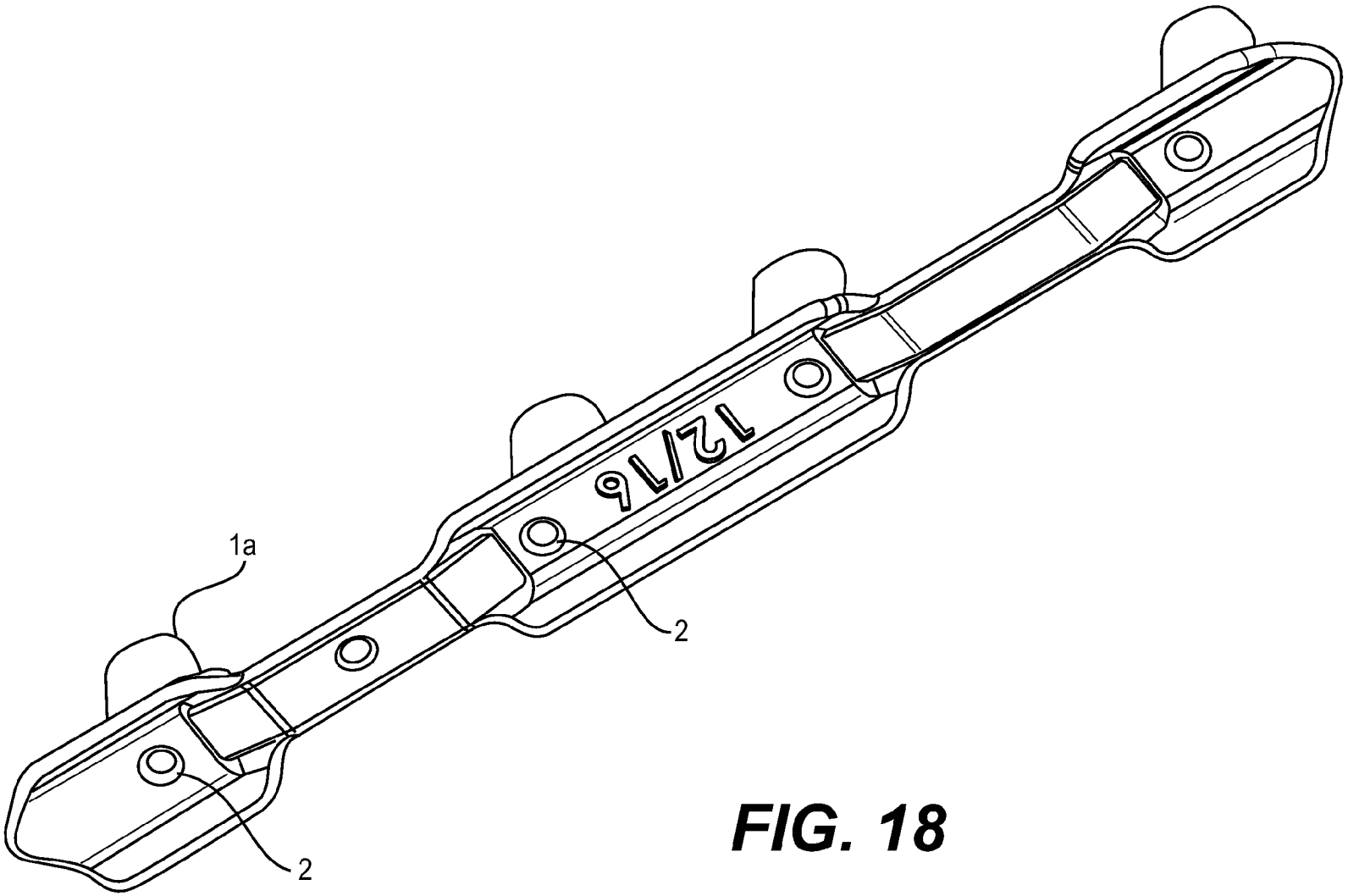
FIG. 18 shows a further perspective view of the grommet strip according to FIG. 17.

In the central portion of the grommet strip 10 the different stringing configurations are achieved by the use of two different (insert) grommet strips 20 which are shown in FIGS. 15 to 18. FIGS. 15 and 16 show a perspective view of a first grommet strip according to a fourth preferred embodiment, which may be used to achieve the stringing configuration shown in the right half of FIG. 13. FIGS. 17 and 18 show a perspective view of a first grommet strip according to a fifth preferred embodiment, which may be used to achieve the stringing configuration shown in the left half of FIG. 13.

Similar to the preferred embodiments described further above, the grommet strip 20 shown in FIGS. 15 and 16 comprises four first grommets 1*a*, wherein the hole axes (not shown) are offset with respect to the grommet axes (not shown) in the longitudinal direction of the grommet strip 20, and two second grommets 1*b*, wherein the hole axes are not offset with respect to the grommet axes in the longitudinal direction of the grommet strip. In the illustrated preferred embodiment, the first grommets 1*a* have a larger extension both in the longitudinal direction of the grommet strip and along the grommet axis than the second grommets 1*b*. The grommet strip shown in FIGS. 15 and 16 thus provides six grommet through-holes 2 in total which roughly correspond to the grommet numbers 1, 2 and 3 in FIG. 13 (right half).

By contrast, the grommet strip 20 shown in FIGS. 17 and 18 comprises four grommets 1*a*, wherein the hole axes (not shown) are offset with respect to the grommet axes (not shown) in the longitudinal direction of the grommet strip 20, and two blind grommets 1*c*, which do not have grommet through-holes 2. The blind grommets have essentially the same outer dimensions or the same geometry as the second grommets 1*b* of FIGS. 15 and 16. The grommet strip shown in FIGS. 17 and 18 thus provides four grommet through-holes 2 in total which roughly correspond to the grommet numbers 1 and 3 in FIG. 13 (left half).

While FIGS. 13 and 14 show the grommet strip 20 being inserted into an opening 11 of a grommet strip 10, the grommet strip 20 may also be directly inserted into a similar opening provided directly in the racket frame.

Figure 19:
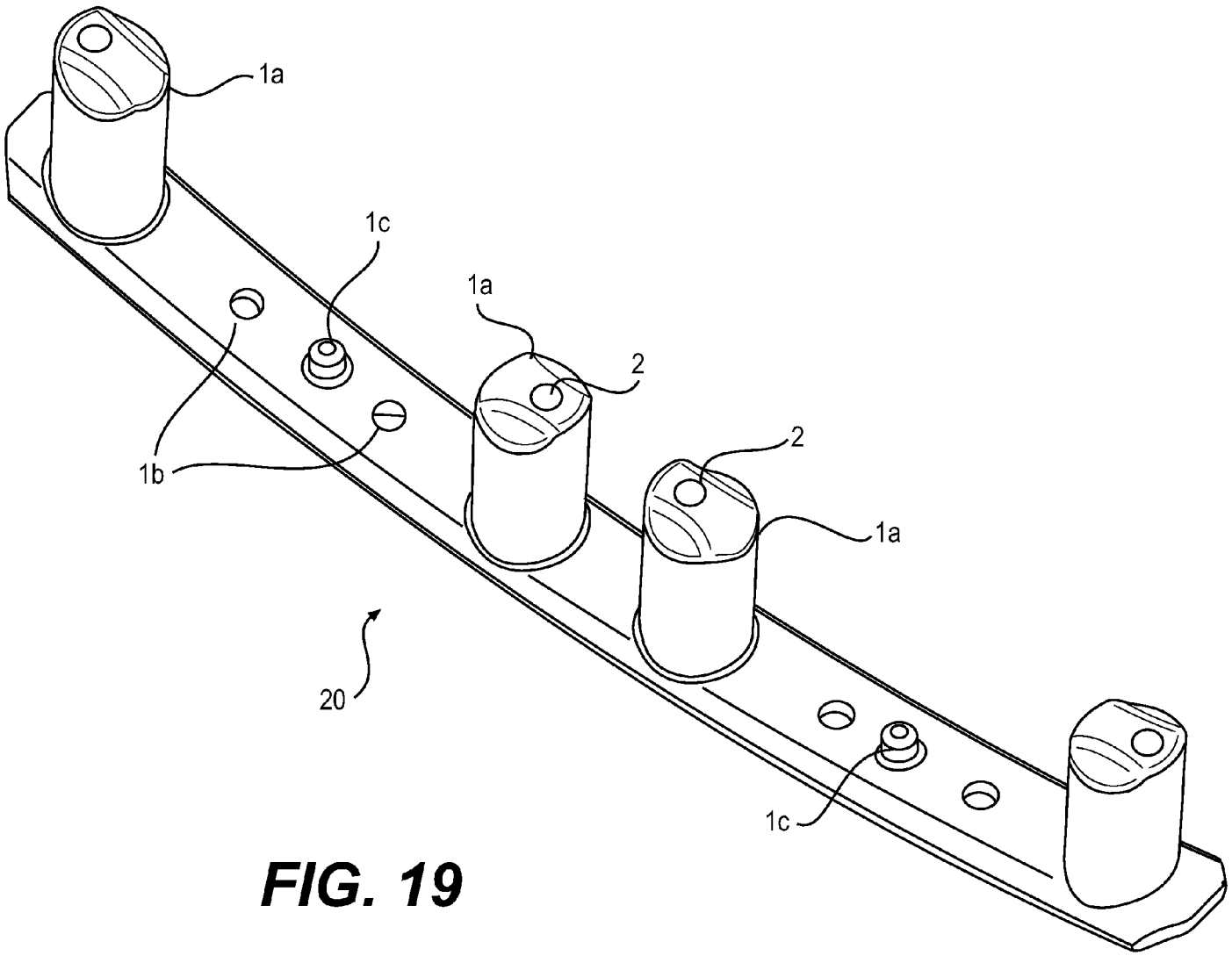
FIG. 19 shows a perspective view of a grommet strip according to a sixth preferred embodiment.
Figure 20:
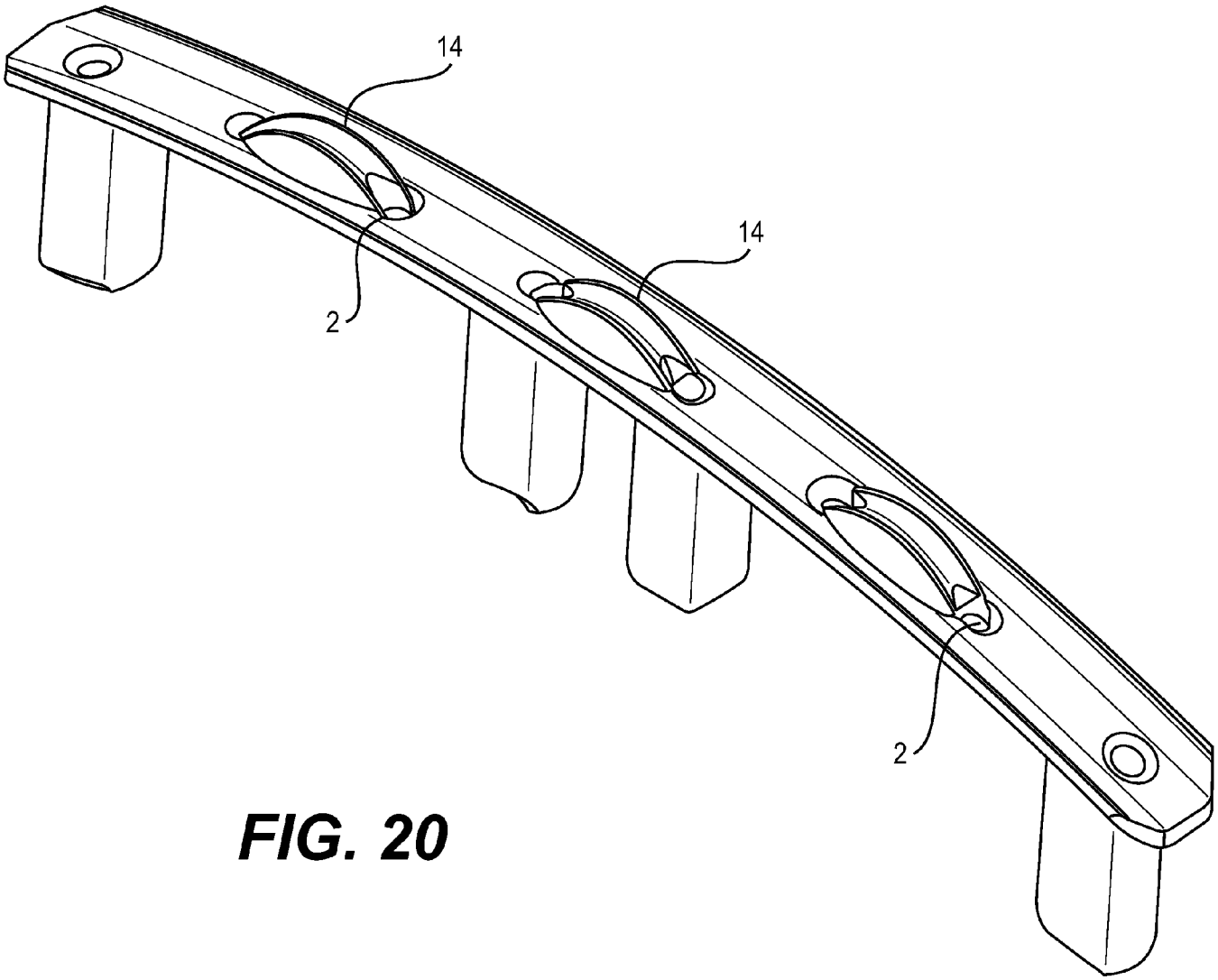
FIG. 20 shows a further perspective view of the grommet strip according to FIG. 19.

FIGS. 19 and 20 show a perspective view of a grommet strip according to a sixth preferred embodiment, which is similar to the fourth embodiment. Said grommet strip may be used as the grommet strip shown in FIGS. 15 and 16 together with a correspondingly adapted grommet strip 10 (see FIGS. 13 and 14). However, it is also preferred that the grommet strip shown in FIGS. 19 and 20 may be employed in a tennis racket (or any other ball games racket) by directly applying or attaching said grommet strip to a portion of the racket frame, in particular to an upper portion of the racket frame opposite the handle of the racket (i.e. at about 12 o'clock), similar as discussed above with respect to FIGS. 1 to 10. For this purpose, the racket head preferably comprises a plurality of first and second bores for accommodating the first and second grommets 1*a* and 1*b* (see FIG. 21) as well as the blind grommets 1*c*.

Figure 21:
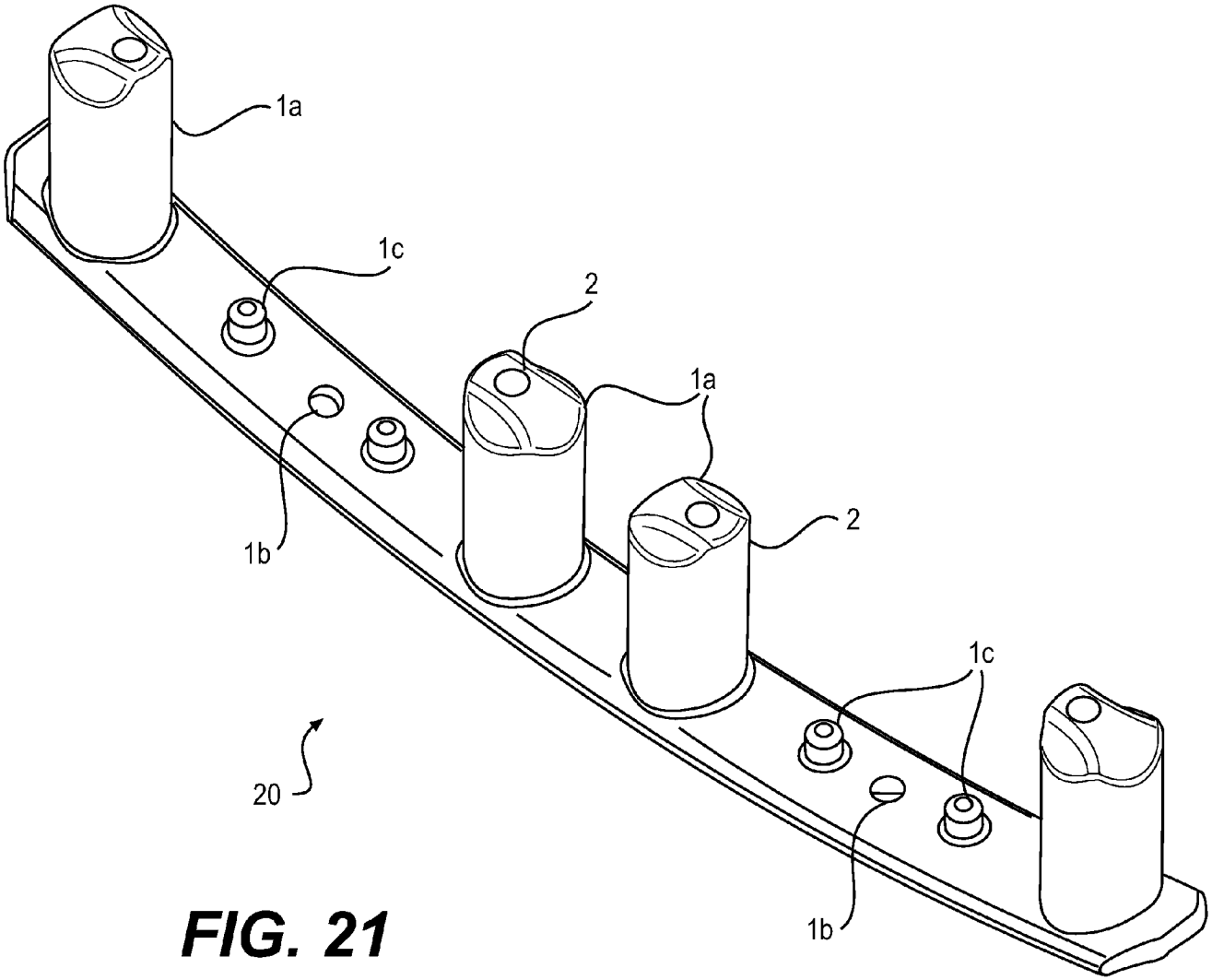
FIG. 21 shows a perspective view of a grommet strip according to a seventh preferred embodiment.
Figure 22:
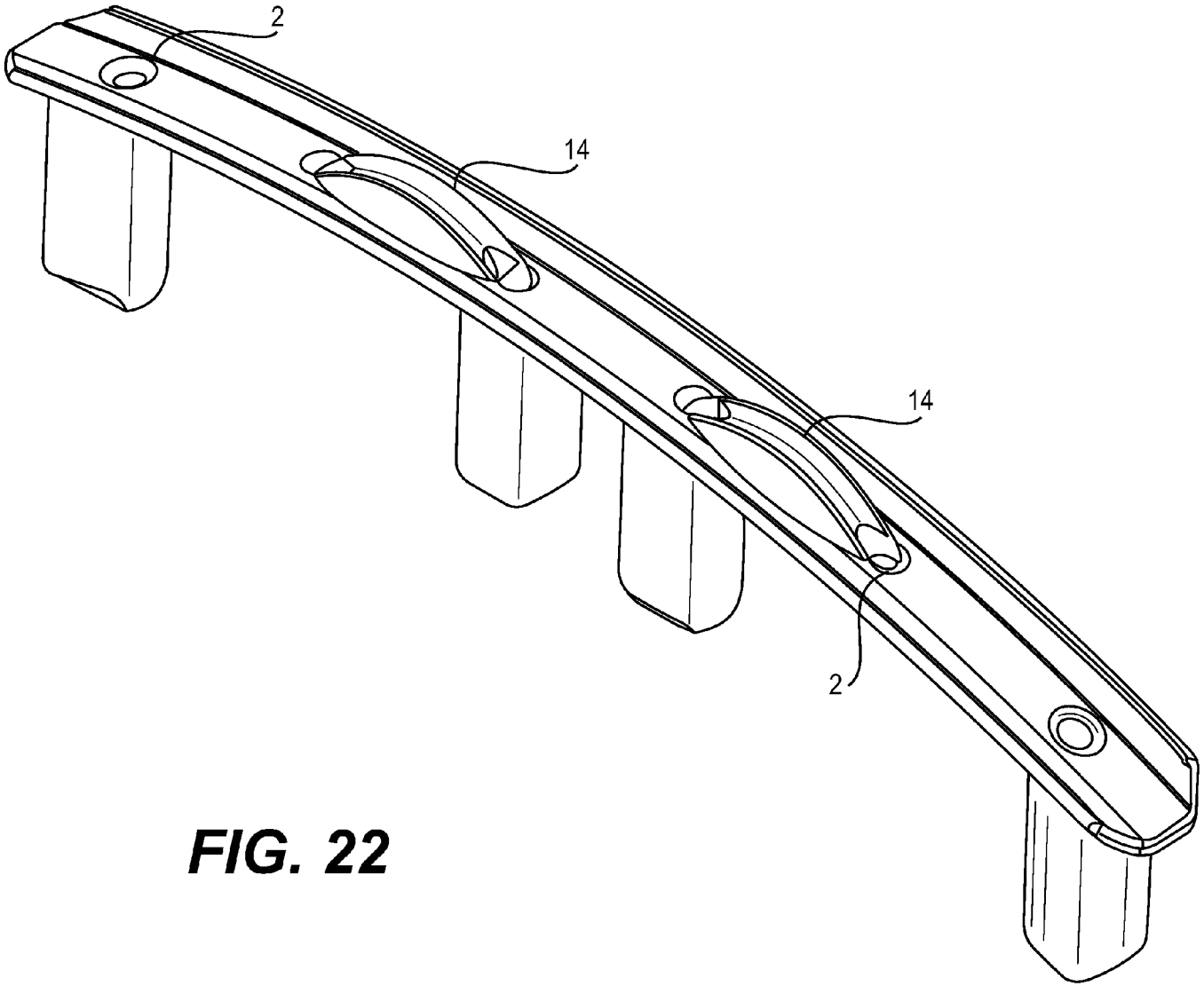
FIG. 22 shows a further perspective view of the grommet strip according to FIG. 17.

As discussed above with respect to the other preferred embodiments, the grommet strip shown in FIGS. 19 and 20 may be replaced with the grommet strip shown in FIGS. 21 and 22 to achieve different stringing configurations (not shown).

Similar to the preferred embodiments described further above, the grommet strip 20 shown in FIGS. 19 and 20 comprises four first grommets 1*a*, wherein the hole axes (not shown) are offset with respect to the grommet axes (not shown) in the longitudinal direction of the grommet strip 20, and four second grommets 1*b*, which essentially consist of through-holes only such that the hole axes are not offset with respect to the grommet axes in the longitudinal direction of the grommet strip. In the illustrated preferred embodiment, the first grommets 1*a* have a larger extension both in the longitudinal direction of the grommet strip and along the grommet axis than the second grommets 1*b*. The grommet strip shown in FIGS. 19 and 20 thus provides eight grommet through-holes 2 in total.

By contrast, the grommet strip 20 shown in FIGS. 21 and 22 comprises four grommets 1*a*, wherein the hole axes (not shown) are offset with respect to the grommet axes (not shown) in the longitudinal direction of the grommet strip 20, two second grommets 1*b*, which essentially consist of through-holes only such that the hole axes are not offset with respect to the grommet axes in the longitudinal direction of the grommet strip, and four blind grommets 1*c*, which do not have grommet through-holes 2. The blind grommets have essentially the same outer diameter as the second grommets 1*b* of FIGS. 19 and 20. Thus, the bores provided in the racket head to allow for a string to pass through both the grommet through-holes of the second grommets 1*b* provided in the grommet strip of FIGS. 19 and 20 as well as said bores may be closed or sealed by means of the blind grommets 1*c* of the grommet strip shown in FIGS. 21 and 22.

The grommet strip shown in FIGS. 21 and 22 thus provides six grommet through-holes 2 in total.

As shown in FIGS. 20 and 22, the grommet strip may comprise one or more ducts or conducts 14 for guiding the strings between two adjacent grommet holes 2. Such duct may comprise, e.g., a curved notch or channel which protrudes from the outer surface of the grommet strip (opposite to the inner surface which comprises the grommets). Of course, the ducts or conducts shown in FIGS. 20 and 22 may also be employed in any of the other embodiments discussed above.

The invention claimed is:

1. A set of grommet strips for a racket for ball games, wherein the set includes:

a first grommet strip and a second grommet strip, wherein each of the first grommet strip and the second grommet strip includes:

a longitudinal direction and a plurality of grommets comprising grommet through-holes, wherein each of the grommets defines a grommet axis, and each of the grommet through-holes defines a hole axis, wherein the grommet axes and the hole axes extend substantially parallel to or are collinear to each other, and wherein the hole axes of some grommets are offset with respect to the grommet axes of the respective first grommet strip or second grommet strip, wherein the distances between adjacent grommet through-holes of the first grommet strip differ from the distances between adjacent grommet through-holes of the second grommet strip, wherein the first grommet strip and the second grommet strip are configured to be inserted into the racket at a same location at different times to enable the racket to be strung in a first configuration when the first grommet strip is inserted into the racket, and in a second configuration when the second grommet strip is inserted into the racket, the second configuration not attainable by the first grommet strip.

2. The set of grommet strips according to claim 1, wherein the distance between directly adjacent grommet through-holes of the first grommet strip or the second grommet strip varies by not more than 40% with respect to the smallest distance between any directly adjacent grommet through-holes of the first grommet strip or the second grommet strip.

3. The set of grommet strips according to claim 1, wherein the offset between the hole axes with respect to the grommet axes of either the first grommet strip and the second grommet strip is from 0.4 mm and 2 mm.

4. The set of grommet strips according claim 1, wherein the grommets of both the first grommet strip and the second grommet strip comprise first grommets, in which the hole axes are offset with respect to the grommet axes of the respective first grommet strip or second grommet strip, and second grommets, in which the hole axes are not offset with respect to the grommet axes of the respective first grommet strip or second grommet strip.

5. The set of grommet strips according to claim 4, wherein the first grommets have a larger extension in the longitudinal direction of the first grommet strip or second grommet strip than the second grommets, and wherein the extension of the first grommets in the longitudinal direction of the first grommet strip or the second grommet strip is larger than the extension of the second grommets in the longitudinal direction of the first grommet strip or the second grommet strip by at least 50%.

6. The set of grommet strips according to claim 4, wherein at least four first grommets are provided in the first grommet strip and the second grommet strip.

7. The set of grommet strips according to claim 4, wherein both the first grommet strip and the second grommet strip further comprise one or more blind grommets without grommet through-holes, and the blind grommets have the same outer dimensions as the second grommets.

8. A set including a racket for ball games, and the set of grommet strips according to claim 1, wherein the racket for ball games is configured to alternatively accommodate only one of the first grommet strip and the second grommet strip at the same location at a given time.

9. A grommet strip for a racket for ball games, wherein the grommet strip comprises:

a longitudinal direction and a plurality of grommets including first grommets having two grommet through-holes and second grommets having only one grommet through-hole, a first pair of first grommets that are directly adjacent to one another, and a second pair of first grommets that are directly adjacent to one another, wherein the grommets form a first set of grommet through-holes for a first stringing configuration of the racket for ball games, and a second set of grommet through-holes for a second stringing configuration of the racket for ball games, wherein the distance between directly adjacent grommet through-holes of the first set varies by not more than 50% with respect to a smallest distance between any directly adjacent grommet through-holes of the first set, wherein the distance between directly adjacent grommet through-holes of the second set varies by not more than 50% with respect to a smallest distance between any directly adjacent grommet through-holes of the second set, and wherein the first stringing configuration differs from the second stringing configuration, the smallest distance between any directly adjacent grommet through-holes of the first set is larger than the largest distance between any directly adjacent grommet through-holes of the second set, and the ratio of the smallest distance between any directly adjacent grommet through-holes of the first set to the largest distance between any directly adjacent grommet through-holes of the second set is at least 1.05.

10. The grommet strip according to claim 9, wherein the distance between directly adjacent grommet through-holes of the first set varies by not more than 40% with respect to the smallest distance between any directly adjacent grommet through-holes of the first set, and/or wherein the distance between directly adjacent grommet through-holes of the second set varies with respect to the smallest distance between any directly adjacent grommet through-holes of the second set by not more than 40%.

11. The grommet strip according to claim 9, wherein the first set of grommet through-holes is formed of first and second grommets, and the second set of grommet through-holes is formed of first and second grommets.

12. The grommet strip according to claim 9, wherein at least four first grommets are provided.

13. The grommet strip according to claim 9, wherein some of the second grommets are arranged so as to be directly adjacent to each other.

14. A racket, comprising:

a grommet strip including:

a longitudinal direction and a plurality of grommets including first grommets having two grommet through-holes and second grommets having only one grommet through-hole, a first pair of first grommets that are directly adjacent to one another, and a second pair of first grommets that are directly adjacent to one another, wherein the grommets form a first set of grommet through-holes for a first stringing configuration of the racket, and a second set of grommet through-holes for a second stringing configuration of the racket, wherein the distance between directly adjacent grommet through-holes of the first set varies by not more than 50% with respect to a smallest distance between any directly adjacent grommet through-holes of the first set, wherein the distance between directly adjacent grommet through-holes of the second set varies by not more than 50% with respect to a smallest distance between any directly adjacent grommet through-holes of the second set, and wherein the first stringing configuration differs from the second stringing configuration; and one or more strings forming a string bed, the one or more strings extending through only one of the two grommet through-holes of at least one of the first grommets, and the other of the two grommet through-holes in the at least one of the first grommets is empty, in the first stringing configuration, wherein the one or more strings are disposed only through the first set of grommet through-holes in the first stringing configuration.

15. The racket according to claim 14, wherein the one or more strings are disposed only through the second set of grommet through-holes in the second stringing configuration.

16. A grommet strip for a racket for ball games, wherein the grommet strip comprises:

a longitudinal direction and a plurality of grommets including first grommets having two grommet through-holes and second grommets having only one grommet through-hole, a first pair of first grommets that are directly adjacent to one another, and a second pair of first grommets that are directly adjacent to one another, wherein the grommets form a first set of grommet through-holes for a first stringing configuration of the racket for ball games, and a second set of grommet through-holes for a second stringing configuration of the racket for ball games, wherein the distance between directly adjacent grommet through-holes of the first set varies by not more than 50% with respect to a smallest distance between any directly adjacent grommet through-holes of the first set, wherein the distance between directly adjacent grommet through-holes of the second set varies by not more than 50% with respect to a smallest distance between any directly adjacent grommet through-holes of the second set, and wherein the first stringing configuration differs from the second stringing configuration;

further comprising exactly one second grommet between one grommet of the first pair of first grommets and one grommet of the second pair of first grommets, wherein the exactly one second grommet is the only grommet between the one grommet of the first pair of first grommets and the one grommet of the second pair of first grommets.

17. The grommet strip according to claim 9, wherein the first grommets each have only two grommet through-holes.

18. The set of grommet strips according to claim 4, wherein each of the first grommets of the first grommet strip are positioned in a location corresponding to one of the first grommets of the second grommet strip.

19. The set of grommet strips according to claim 18, wherein both the first grommet strip and the second grommet strip further comprise one or more blind grommets without grommet through-holes, and at least one blind grommet of the first grommet strip is positioned in a location corresponding to a respective second grommet of the second grommet strip, and at least one second grommet of the first grommet strip is positioned in a location corresponding to a respective blind grommet of the second grommet strip.

20. The grommet strip according to claim 16, wherein the grommet strip extends from a first end toward a second end, wherein grommets closest to the first end and the second end of the grommet strip are first grommets.

21. The grommet strip according to claim 20, further including a plurality of second grommets directly adjacent to the first grommet closest to the first end, and a plurality of second grommets directly adjacent to the first grommet closest to the second end.

22. The grommet strip according to claim 21, wherein the plurality of second grommets directly adjacent to the first grommet closest to the first end includes exactly three second grommets, and the plurality of second grommets directly adjacent to the first grommet closest to the second end includes exactly three second grommets.

23. The grommet strip according to claim 21, wherein the grommet strip includes exactly six first grommets and exactly seven second grommets.

24. The grommet strip of claim 9, further comprising exactly one second grommet between one grommet of the first pair of first grommets and one grommet of the second pair of first grommets, wherein the exactly one second grommet is the only grommet between the one grommet of the first pair of first grommets and the one grommet of the second pair of first grommets.

25. The racket of claim 14, wherein the grommet strip includes exactly one second grommet between one grommet of the first pair of first grommets and one grommet of the second pair of first grommets, wherein the exactly one second grommet is the only grommet between the one grommet of the first pair of first grommets and the one grommet of the second pair of first grommets.

* * * * *